US009244382B2

(12) United States Patent
Yamamoto et al.

(10) Patent No.: US 9,244,382 B2
(45) Date of Patent: Jan. 26, 2016

(54) IMAGE FORMING APPARATUS

(71) Applicant: CANON KABUSHIKI KAISHA, Tokyo (JP)

(72) Inventors: Tatsuyuki Yamamoto, Tokyo (JP); Takao Nakajima, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/302,848

(22) Filed: Jun. 12, 2014

(65) Prior Publication Data

US 2014/0376968 A1 Dec. 25, 2014

(30) Foreign Application Priority Data

Jun. 25, 2013 (JP) ..... 2013-132533
Aug. 30, 2013 (JP) ..... 2013-179550

(51) Int. Cl.
*G03G 15/08* (2006.01)

(52) U.S. Cl.
CPC ..... *G03G 15/0867* (2013.01); *G03G 15/0886* (2013.01)

(58) Field of Classification Search
CPC ..... G03G 15/0886; G03G 15/0872; G03G 21/1676; G03G 2215/0692; G03G 15/0865; G03G 15/0877; G03G 15/0868; G03G 15/0863; G03G 15/0875; G03G 2215/067; G03G 15/0867; G03G 15/0879; G03G 2221/1823
See application file for complete search history.

(56) References Cited

U.S. PATENT DOCUMENTS

| | | | |
|---|---|---|---|
| 5,708,925 | A | 1/1998 | Kobayashi et al. |
| 6,766,133 | B1 | 7/2004 | Ban et al. |
| 7,412,192 | B2 | 8/2008 | Nakajima et al. |
| 7,428,393 | B2 | 9/2008 | Hosokawa et al. |
| 7,447,470 | B2 | 11/2008 | Lee |
| 7,466,945 | B2 | 12/2008 | Hattori |
| 7,738,817 | B2 | 6/2010 | Sasae et al. |
| 2005/0158071 | A1 | 7/2005 | Hosokawa et al. |
| 2005/0196199 | A1 | 9/2005 | Hattori |

(Continued)

FOREIGN PATENT DOCUMENTS

| | | | |
|---|---|---|---|
| EP | 1 041 453 | A2 | 10/2000 |
| EP | 1548518 | A1 | 6/2005 |
| EP | 1 818 729 | A1 | 8/2007 |
| EP | 1548518 | B1 | 2/2012 |
| EP | 2 657 789 | A2 | 10/2013 |

(Continued)

OTHER PUBLICATIONS

Oct. 29, 2014 European Search Report in European Patent Application No. 14173411.1.

*Primary Examiner* — Roy Y Yi
(74) *Attorney, Agent, or Firm* — Fitzpatrick, Cella, Harper & Scinto

(57) ABSTRACT

An image forming apparatus includes: a bottle which is detachably mounted on an apparatus body to store toner; a shutter which is disposed on the bottle to open and close a discharge port which discharges the toner; and a shutter slider which is disposed in the apparatus body to open and close the shutter by engaging therewith along with an insertion operation of the bottle. The shutter slider is disposed to be movable from a first position, which allows the shutter to be located at a closed position at which the discharge port is closed by the shutter when the bottle is mounted on the apparatus body, to a second position, in which the discharge port is to be opened and closed by the shutter along with an operation of attaching and detaching the bottle to and from the apparatus body.

12 Claims, 20 Drawing Sheets

(56) References Cited

U.S. PATENT DOCUMENTS

| | | | | |
|---|---|---|---|---|
| 2006/0285885 | A1 | 12/2006 | Lee | |
| 2008/0260422 | A1 | 10/2008 | Sasae et al. | |
| 2010/0092196 | A1 | 4/2010 | Mimura | |
| 2010/0129118 | A1 | 5/2010 | Kimura et al. | |
| 2010/0329746 | A1 | 12/2010 | Sato | |
| 2011/0286771 | A1* | 11/2011 | Taguchi et al. | 399/258 |
| 2012/0257912 | A1 | 10/2012 | Hasebe | |
| 2013/0287446 | A1 | 10/2013 | Cavill et al. | |

FOREIGN PATENT DOCUMENTS

| | | | |
|---|---|---|---|
| JP | 2005-189423 | A | 7/2005 |
| JP | 2005-284244 | A | 10/2005 |
| JP | 2006-139069 | A | 6/2006 |
| JP | 2007-004164 | A | 1/2007 |
| JP | 4341957 | B2 | 10/2009 |
| JP | 4579655 | B2 | 11/2010 |
| JP | 4656561 | A | 3/2011 |
| WO | 2006/052005 | A2 | 5/2006 |

* cited by examiner

IMAGE FORMING APPARATUS

BACKGROUND OF THE INVENTION

1. Field of the Invention

The present invention relates to an image forming apparatus including a toner replenishing portion in which toner is replenished from a toner bottle detachably mounted thereon.

2. Description of the Related Art

Conventionally, in an image forming apparatus including a toner replenishing portion in which toner is replenished from a toner bottle, there is known a configuration in which an openable/closable shutter disposed in a toner bottle is opened when the toner bottle is inserted into a body of the image forming apparatus (see U.S. Patent Application Publication No. 2005/196199 A1).

In such a configuration, shipment with the toner bottle packaged together in the body is under review, aiming at reducing a packing size of the body or reducing a packing material of the toner bottle.

However, in the configuration of U.S. Patent Application Publication No. 2005/196199 A1, when the toner bottle is packaged together in the body, the shutter is opened when the toner bottle is mounted on the body. Therefore, toner is replenished to the toner replenishing portion from the toner bottle by vibration during transport, which may cause toner scattering.

U.S. Patent Application Publication No. 2005/158071 A1 discloses a configuration aiming at packaging a development device together in the body of the image forming apparatus at the time of shipment. U.S. Patent Application Publication No. 2005/158071 A1 discloses a configuration in which a sealing member connected to a toner conveying portion driven at the time of body motion start is installed separately from the shutter at a toner replenishing inlet to prevent toner leakage from the development device inlet or toner replenishment during transport.

However, the configuration of U.S. Patent Application Publication No. 2005/158071 A1 has a problem in that since the sealing member is provided separately from the shutter in a connecting portion between the development device and the body, the sealing structure of the connecting portion becomes complicated, the size is increased, and the sealing configuration is increased, thus increasing the probability of toner leakage.

SUMMARY OF THE INVENTION

It is desirable to provide an image forming apparatus which does not lead to an increase in a size of the apparatus or an increase in costs, enables a toner bottle to be packaged together with a body for shipment, and can suppress toner scattering or leakage.

In order to achieve the above object, an image forming apparatus according to the present invention includes: a bottle which is detachably mounted on an apparatus body to store toner; a shutter which is disposed on the bottle to open and close a discharge port which discharges the toner; and an engaging member which is disposed in the apparatus body to open and close the shutter by engaging with the shutter along with an insertion operation of the bottle, wherein the engaging member is disposed to be movable from a first position, which allows the shutter to be located at a closed position at which the discharge port is closed by the shutter when the bottle is mounted on the apparatus body, to a second position, in which the discharge port is to be opened and closed by the shutter along with an operation of attaching and detaching the bottle to and from the apparatus body.

Further features of the present invention will become apparent from the following description of exemplary embodiments with reference to the attached drawings.

DESCRIPTION OF THE EMBODIMENTS

First Embodiment

Hereinafter, exemplary embodiments of the present invention will be described in detail with reference to the accompanying drawings. The image forming apparatus of the present invention may also be implemented in another embodiment in which a part or all of the configuration of the embodiment is replaced with alternative configuration, as long as it includes a toner bottle and a toner replenishing portion.

Therefore, four image bearing members contacting an intermediate transfer member are illustrated in drawings, but it is not limited thereto, and the present embodiment also may be implemented in image forming apparatuses having three or less or five or more image bearing members contacting the intermediate transfer member. Further, although only major portions related to toner replenishment are described in the present embodiment, the present invention may be implemented in many uses such as printers, various types of printers, copying machines, facsimile machines, and multifunctional machines by adding necessary appliances, equipment, and casing structures.

(Configuration of Image Forming Apparatus)

Figure 1:
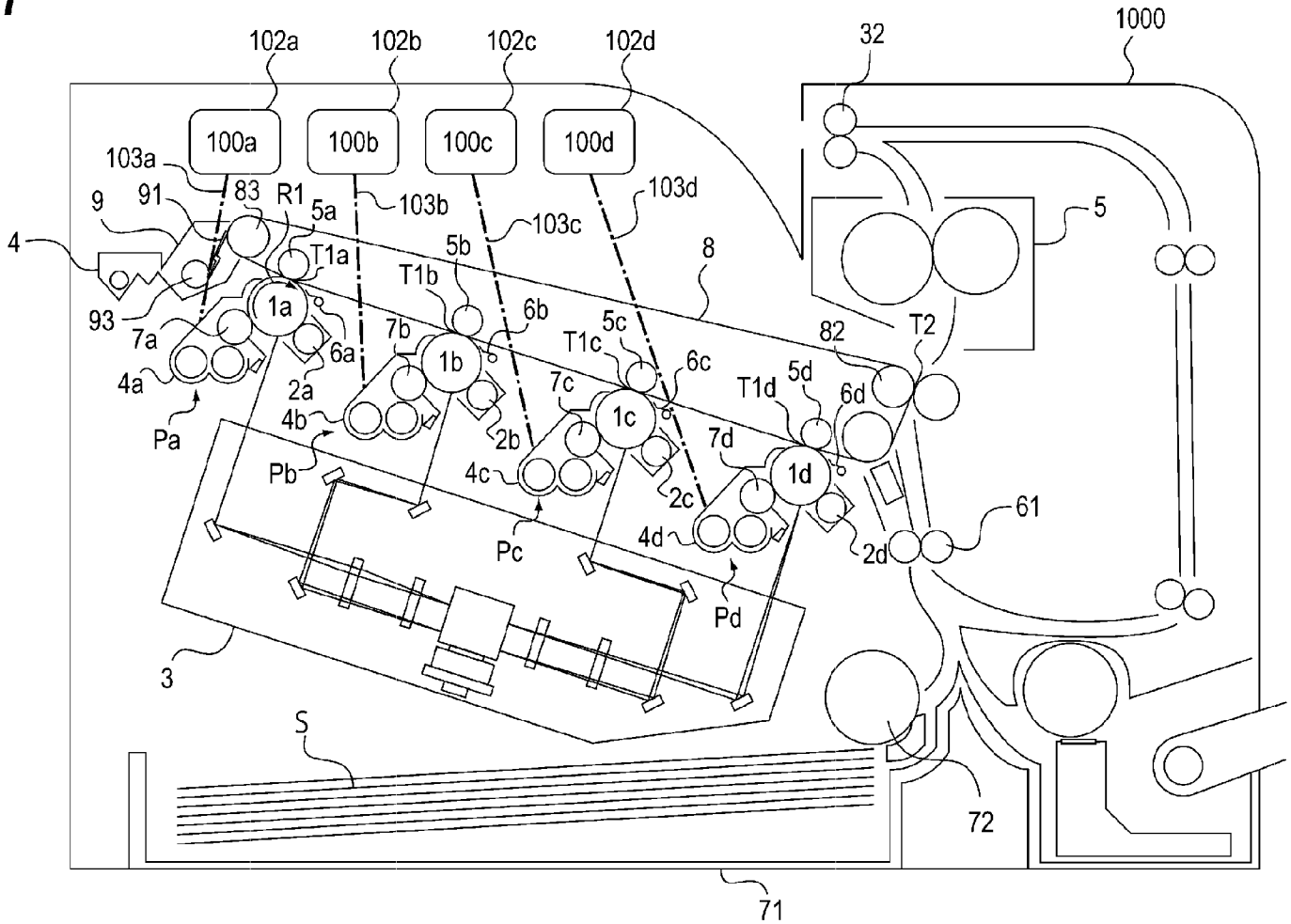
FIG. 1 is a view describing an entire configuration of an image forming apparatus.

A substantial configuration of the image forming apparatus will be described with reference to FIG. 1. FIG. 1 is a view describing an entire configuration of the image forming apparatus according to the present embodiment.

As illustrated in FIG. 1, an image forming apparatus 1000 according to the present embodiment is a tandem-type full-color printer which has four image forming portions Pa, Pb, Pc, and Pd arranged in a straight line section of an intermediate transfer belt 8.

The image forming portion Pa of the uppermost stream has a yellow toner image formed on a photosensitive drum 1*a*, and the image is primary-transferred on the intermediate transfer belt 8 in the primary transfer portion T1*a*. In the image forming portion Pb, a magenta toner image is formed on a photosensitive drum 1*b*, and in the primary transfer portion T1*b* the image is overlapped on the yellow toner image of the intermediate transfer belt 8 to be primary-transferred. Likewise, in the image forming portion Pc and the image forming portion Pd, a cyan toner image and a black toner image are formed respectively on the photosensitive drums 1*c* and 1*d*, and these images are primary-transferred likewise on the intermediate transfer belt 8 in the primary transfer portions T1*c* and T1*d*.

The four-color toner images primary-transferred in sequence on the intermediate transfer belt 8 are conveyed to a secondary transfer portion T2, and are secondary-transferred in bulk on recording material S. The transfer residual toner that has passed the secondary transfer portion T2 and remains on the intermediate transfer belt 8 is removed by a belt cleaning apparatus 9.

In addition, the toner removed by a cleaning blade 91 of the belt cleaning apparatus 9 passes through a toner conveying portion 4 disposed on the back of the body by a toner conveying screw 93 of the belt cleaning apparatus 9, and is conveyed to a recovered toner container (not illustrated).

The recording material S to which the four-color toner image is transferred is thermally pressed by a fixing apparatus 5 such that the toner image is fixed on the surface thereof, and is then discharged from a discharge roller 32 to a discharge tray 31.

The recording material S is sent out from a recording material storage cassette 71 and is separated one by one by a separating apparatus 72 to be delivered to a registration roller 61. The registration roller 61 feeds the recording material S to the secondary transfer portion T2 on time to the toner image of the intermediate transfer belt 8.

The four image forming portions Pa, Pb, Pc and Pd have all the same configuration except that the colors of the toner used in developing apparatuses 4*a*, 4*b*, 4*c* and 4*d* are different like yellow, magenta, cyan and black. Hereinafter, the image forming portion Pa of the uppermost stream will be described, and the other image forming portions Pb, Pc and Pd will be described with the a of the symbol end in the description changed to b, c, and d.

The image forming portion Pa includes a charging apparatus 2*a*, developing apparatus 4*a*, a primary transfer roller 5*a* and a drum cleaning apparatus 6*a*, which are disposed around the photosensitive drum 1*a*. The image forming portion Pa including these photosensitive drum 1*a* and the developing apparatus 4*a* is made into a process cartridge for a maintenance purpose.

The photosensitive drum 1*a* is formed in a metal cylinder on which a negatively charged photosensitive layer is formed on the surface thereof, and rotates in a direction of an arrow R1 at a predetermined process speed.

The charging apparatus 2*a* presses the charging roller to the photosensitive drum 1*a* to rotate the same, and applies a voltage with AC voltage superimposed on DC voltage, to uniformly charge the surface of the photosensitive drum.

An exposing apparatus 3 scans with a polyhedral mirror a laser beam in which scanning line image data with decomposed color image unfolded is on-off modulated, and writes an electrostatic image on the surface of each charged photosensitive drum.

The developing apparatus 4*a* reversely develops the electrostatic image by adhering negatively charged toner to the exposed portion of the electrostatic image of the photosensitive drum 1*a*. The developing apparatus 4*a* rotates a developing sleeve 7*a* carrying toner thereon in a counter direction with respect to the photosensitive drum about a fixed magnetic pole, and applies, to the developing sleeve 7*a*, a developing voltage with AC voltage superimposed on DC voltage of negative polarity from a power source (not illustrated).

The primary transfer roller 5*a* is pressed to the photosensitive drum 1*a* through the intermediate transfer belt 8 to form a primary transfer portion T1*a* between the photosensitive drum 1*a* and the intermediate transfer belt 8. When the intermediate transfer belt 8 on which a negatively charged toner image is superimposed passes through the primary transfer portion T1*a*, a positive DC voltage is applied to the primary transfer roller 5*a* from the power source (not illustrated), thereby a toner image is primary-transferred thereof.

The cleaning apparatus 6*a* removes transfer residual toner remaining on the photosensitive drum 1*a* while passing through the primary transfer portion T1*a* to prepare the next toner image forming.

The image forming apparatus 1000 includes a toner bottle 100 which is detachably mounted on the apparatus body thereof, and is provided with a movable shutter to open and close a discharge port for discharging the toner. The image forming apparatus 1000 is provided with a toner replenishing apparatus 500 in which the toner is replenished from a toner bottle 100. Next, the toner replenishing apparatus 500 will be described.

Figure 2A:
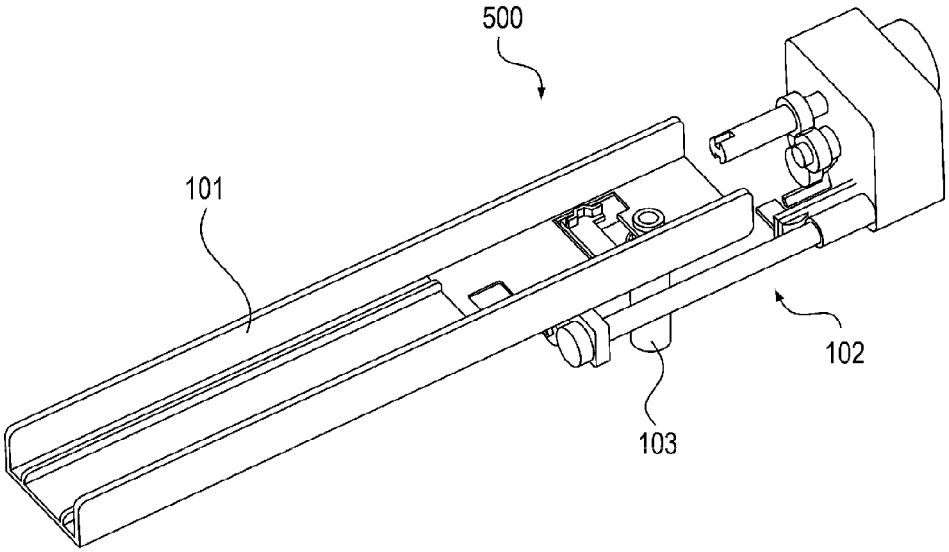
FIGS. 2A and 2B are perspective views of a toner replenishing apparatus.

The toner replenishing apparatus 500 includes bottle mounts 101*a* to 101*d* (101 illustrated in FIGS. 2A and 2B), toner replenishing portions 102*a* to 102*d*, and toner replenishing pipes 103*a* to 103*d*. The bottle mount 101 (see FIGS. 2A and 2B) is a mounting portion on which toner bottles 100*a* to 100*d* storing toner are separately mounted. The toner replenishing portions 102*a* to 102*d* are replenishing portions which receive the toner replenished from the toner bottle 100 mounted thereon. The toner replenishing apparatus 500 replenishes the toner from respective toner bottles 100*a* to 100*d* to respective developing apparatuses 4*a* to 4*d* via respective toner replenishing portions 102*a* to 102*d* and toner replenishing pipes 103*a* to 103*d* according to the quantity of toner accumulated in respective developing apparatuses 4*a* to 4*d*.

(Configuration of Toner Replenishing Apparatus)

The toner replenishing apparatus 500 will be described in more detail with reference to FIGS. 2A, 2B, 3A, and 3B.

As illustrated in FIGS. 2A, 2B, 3A and 3B, the toner replenishing apparatus 500 includes a motor 200 as a driving source, and a drive transmission portion 201 which transmits a driving force of the motor 200. The drive transmission portion 201 interlocks a shutter moving mechanism for moving a shutter slider as an engaging member to be described below and a toner bottle drive transmission member which transmits a driving force to the toner bottle or releases the drive transmission. By this drive transmission portion 201, the shutter moving mechanism and the toner bottle drive transmission member may be driven with the motor 200 which is a common driving power source. This will be described below.

A first output gear 202 is rotated by the driving force from the motor 200 through the drive transmission portion 201. A pivot arm 206 included in the drive transmission member is pivotably disposed coaxially with the first output gear 202. The pivot arm 206 rotatably holds a pivot gear 203 included in the drive transmission member. The pivot gear 203 is meshed with the first output gear 202 to rotate together with the first output gear 202 as it rotates. Therefore, the pivot arm 206 is pivoted about the first output gear 202, so that the pivot gear 203 is connected (meshed) with a second output gear 204, which is a drive gear for transmitting the driving force to the toner bottle 100, or connect is released (disconnected). That is, the pivot arm 206 and the pivot gear 203 included in the drive transmission member are disposed movably between a drive transmission position illustrated in FIGS. 3A and 3B which transmits the driving force to the toner bottle 100 and a release position illustrated in FIGS. 5A, 5B, 7A, and 7B which releases the driving transmission to the toner bottle 100.

The pivot arm 206 is provided with a pivot locking portion 206*a* which is disposed integrally with the pivot arm 206 to be pivoted about the first output gear 202 together with the pivot arm 206. The pivot locking portion 206*a* is disposed engageably with a pivot stopping portion 209*a* of a pivot stopper 209, which is a stopping member movably disposed in an attaching/detaching direction of the toner bottle 100. The pivot stopper 209 is disposed movably between a holding position illustrated in FIGS. 5A, 5B, 7A, and 7B which holds the pivot gear 203 at the release position and a holding release position illustrated in FIGS. 3A and 3B which releases the holding of the release position of the pivot gear 203. The pivot stopping portion 209*a* of the pivot stopper 209 is engaged with the pivot locking portion 206*a* of the pivot arm 206 so as to regulate the pivoting of the pivot arm 206, so that the state in which the pivot gear 203 is disconnected from the second output gear 204 is maintained (see FIGS. 5A, 5B, 7A, and 7B). That is, when the pivot stopping portion 209*a* of the pivot stopper 209 is engaged with the pivot locking portion 206*a* of the pivot arm 206, the state (release position) in which the transmission of the driving force to the toner bottle is blocked is maintained.

Meanwhile, the pivot stopper 209 is provided with a first worm wheel 209*b* which receives the driving force from a first worm gear 208 included in the shutter moving mechanism. The first worm wheel 209*b* is meshed with the first worm gear 208 in a state in which the pivot gear 203 is disconnected from the second output gear 204 (see FIGS. 5A, 5B, 7A, and 7B). Therefore, when the driving force is transmitted to the first worm wheel 209*b* from the first worm gear 208, the pivot stopper 209 is moved in a direction opposite to the toner bottle insertion direction (the direction of the arrow in FIGS. 2A and 2B). Therefore, the engagement between the pivot stopping portion 209*a* of the pivot stopper 209 and the pivot locking portion 206*a* of the pivot arm 206 is released, so that the pivot arm 206 becomes pivotable. Therefore, if the first output gear 202 rotates, the pivot arm 206 is pivoted to contact the pivot gear 203 with the second output gear 204 (see FIGS. 3A and 3B). In this state, the driving force is transmitted to the toner bottle.

The toner replenishing apparatus 500 includes a shutter slider 213 which is disposed on the bottle mount 101 slidably in the attaching/detaching direction of the toner bottle 100. The shutter slider 213 is disposed to be movable from a first position (see FIGS. 5A and 5B) which allows a shutter 301 to be located at a closed position in which the discharge port is closed by the shutter, when the toner bottle 100 is mounted on the apparatus body, to a second position (see FIGS. 3A and 3B) in which the discharge port can be opened and closed by the shutter 301 along with the operation of attaching and detaching the toner bottle 100 to and from the apparatus body. As will be described below, the shutter slider 213 is assembled at the first position during assembly of the apparatus, is located at the first position during shipment, and is moved to the second position by the driving force transmitted during installation. The shutter slider 213 is provided with a shutter stopping portion 213*a* which is engaged with the shutter 301 (a shutter locking portion 301*a*) of the toner bottle 100. The shutter slider 213 is an engaging member which opens and closes the shutter 301 of the toner bottle 100 by engaging with the shutter 301 of the toner bottle 100 along with the insertion operation of the toner bottle 100. Further, the shutter slider 213 is provided with a second worm wheel 213*b* which is meshed with a second worm gear 212*a* included in the shutter moving mechanism (see FIGS. 3B and 5B). In addition, the shutter slider 213 is provided with a slider locking portion 213*c* which stops the movement of the shutter slider 213 in the toner bottle insertion direction (the direction of the arrow in FIGS. 2A and 2B), by engaging with a slider stopping portion 215*a* protruding downward from the bottom of a replenishing base 215.

An output axis 207 and the first worm gear 208 included in the shutter moving mechanism are rotated by the driving force transmitted from the motor 200 through the drive transmission portion 201. The drive mount 214 holds the output axis 207 (a first idler gear 210), a second idler gear 211, and a shutter sliding gear 212. If the second worm gear 212*a* of the shutter sliding gear 212 is meshed with the second worm wheel 213*b* of the shutter slider 213, the shutter slider 213 is moved from the first position to the second position by the driving force transmitted thereto. As will be described below, the shutter slider 213 which is moved to the second position is meshed with the shutter 301 at the time of inserting the toner bottle into the apparatus body. Therefore, along with the insertion operation of the toner bottle into the apparatus body, the shutter 301 can be moved from a sealing position for maintaining the sealing of the discharge port to an opening position for releasing the sealing.

(Configuration of Toner Bottle)

The configuration of the toner bottle will be described with reference to FIGS. 4A and 4B. Moreover, the toner bottle has the same configuration as the toner bottles 100*a* to 100*d* illustrated in FIG. 1, except that the stored toner colors are different. Hereinafter, the toner bottle 100 will be described.

Figure 2B:
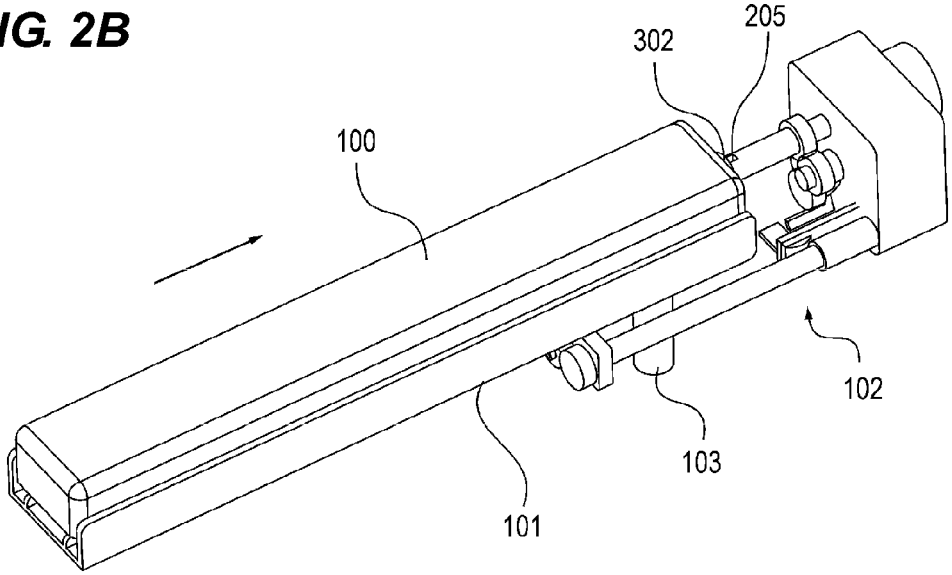
Figure 4A:
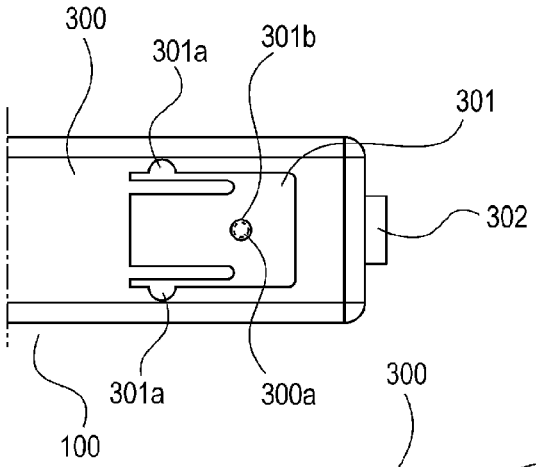
FIG. 4A is a bottom view of a toner bottle.
Figure 4B:
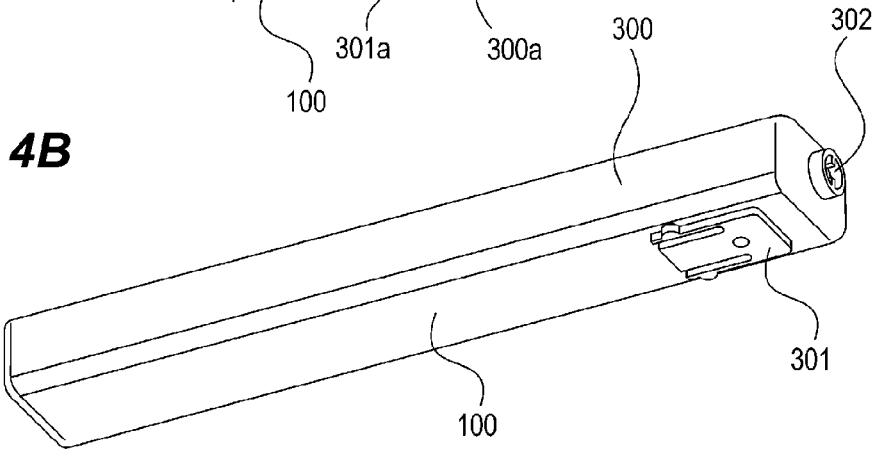
FIG. 4B is a perspective view of the toner bottle.

As illustrated in FIGS. 4A and 4B, the toner bottle 100 has a bottle case 300 which is a storage portion for storing the toner, the movable shutter 301 which seals the toner discharge port 300*a* formed in the bottle case 300, and an input coupling 302 to which the driving force is transmitted from the body side. The shutter 301 is provided with the shutter locking portion 301*a* to be described below, and a communication port 301*b*. As illustrated in FIG. 2B, the toner bottle 100 mounted on the bottle mount 101 of the body side is connected with the input coupling 302 of the toner bottle 100 and the output coupling 205 of the body side.

(Functions of Respective Portions of Toner Replenishing Apparatus)

Next, the functions of the respective portions of the toner replenishing apparatus will be described schematically.

Figure 3A:
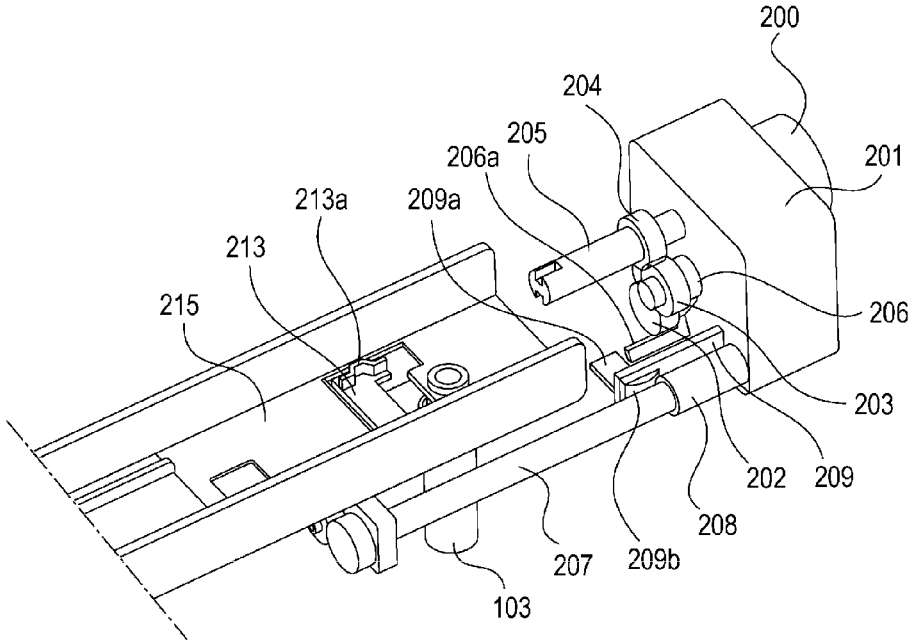
FIGS. 3A and 3B are perspective views of major portions of the toner replenishing apparatus.
Figure 3B:
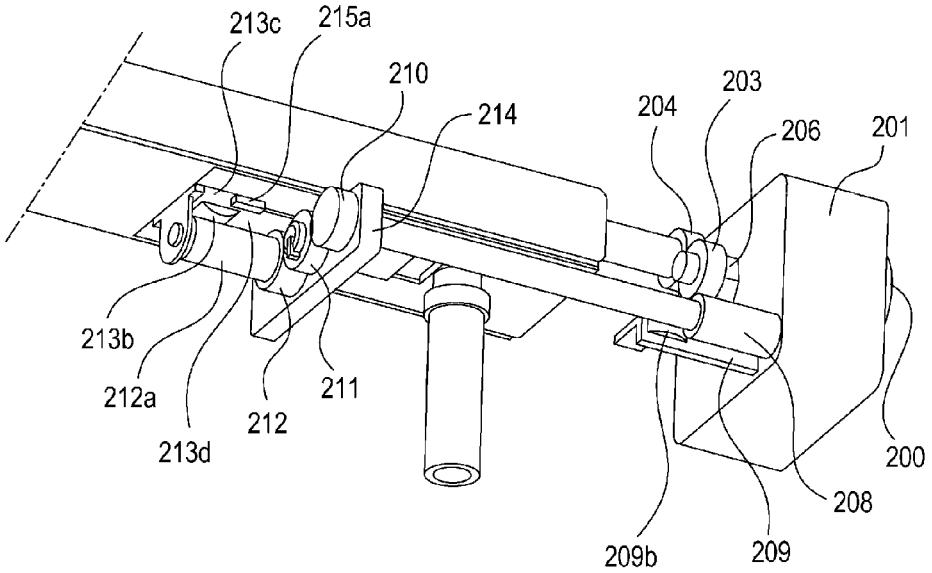

When not mounting on the body, the shutter 301 of the toner bottle 100 is configured to seal the discharge port 300*a* for preventing the toner in the toner bottle 100 from leaking to an outside thereof (see FIGS. 6A and 6B), and slide in the insertion direction of the toner bottle 100. At this time, the shutter 301 slides downstream in the insertion direction from a position in which the discharge port 300*a* communicates with the communication port 301*b*, so as to attain the sealing in a communication release state. When the toner bottle 100 is inserted into the apparatus body, the shutter 301 is engaged with the shutter slider 213 which is moved to the second position, at the stage in which the toner bottle 100 is inserted into a predetermined position. At this time, the shutter slider 213 is at a position illustrated in FIGS. 3A and 3B, which is a second position in which the discharge port 300*a* can be opened and closed by the shutter 301 along with the operation of attaching and detaching the toner bottle 100 to and from the apparatus body. At this position, the shutter locking portion 301*a* of the shutter 301 is engaged with the shutter stopping portion 213*a* disposed on the shutter slider 213 of the toner replenishing apparatus. At this time, as illustrated in FIGS. 3A and 3B, the slider locking portion 213*c* of the shutter slider 213 is locked with the slider stopping portion 215*a* of the replenishing base 215, and thus, the movement of the shutter slider 213 in the toner bottle insertion direction of the shutter slider 213 (the direction of the arrow in FIGS. 2A and 2B) is stopped at the second position. Therefore, if the toner bottle 100 is further inserted, the shutter 301 slides relative to the toner bottle 100 by the movement of the toner bottle 100, and the discharge port 300*a* and the communication port 301*b* are overlapped to communicate with each other, so that toner replenishment is made possible (see FIGS. 4A to 4C).

The input coupling 302 of the toner bottle 100 is engaged with the output coupling 205 of the toner replenishing apparatus so as to transmit the driving force to the toner conveying member (not illustrated) disposed in the toner bottle 100.

The first output gear 202, the pivot gear 203, the second output gear 204 and the pivot arm 206 transmit the driving force from the drive transmission portion 201 to the output coupling 205. The pivot arm 206 is pivoted while rotatably holding the pivot gear 203 about the first output gear 202 as a rotation center.

Figure 5A:
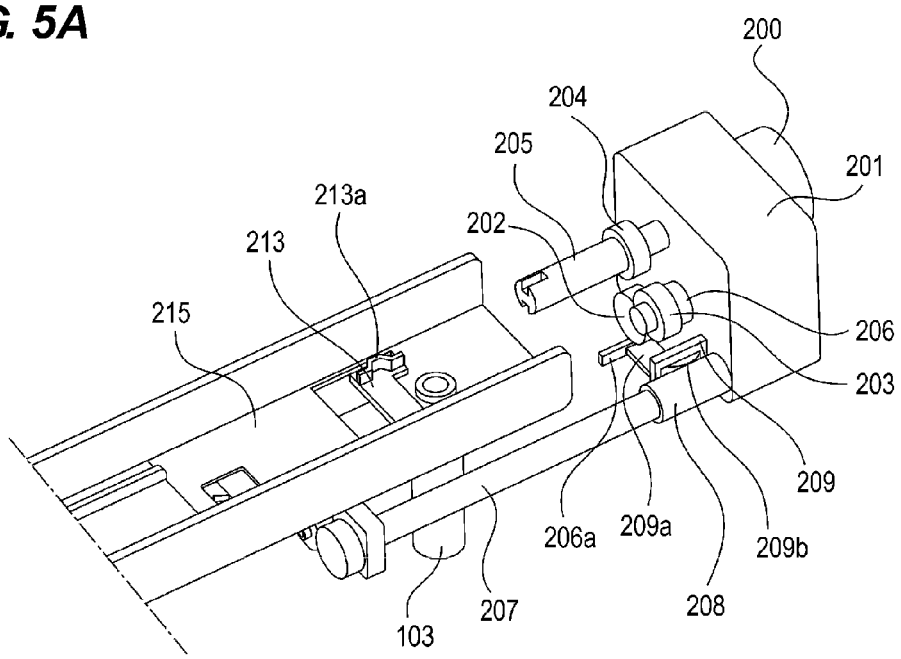
FIGS. 5A and 5B are perspective views of the major portions of the toner replenishing apparatus.
Figure 5B:
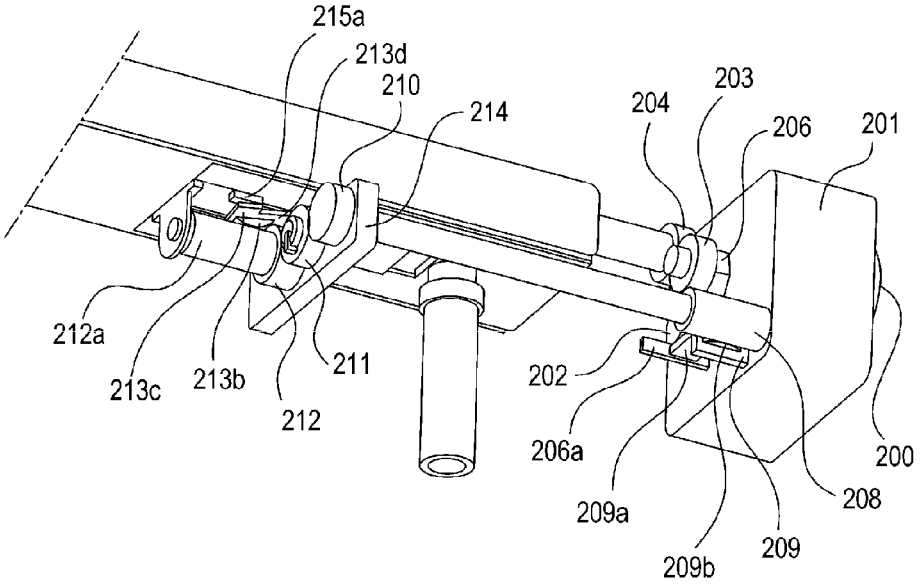

The pivot stopper 209 disposed movably in the attaching and detaching direction of the toner bottle 100 has the pivot stopping portion 209*a* engaged with the pivot locking portion 206*a* of the pivot arm 206, at the position in which the first worm wheel 209*b* is meshed with the first worm gear 208, as illustrated in FIGS. 5A and 5B. When the pivot stopping portion 209*a* of the pivot stopper 209 is engaged with the pivot locking portion 206*a* of the pivot arm 206, the pivot gear 203 is disconnected from the second output gear 204. In this state, the pivoting of the pivot arm 206 (transmission of the driving to the output coupling 205) is stopped.

As illustrated in FIG. 5A, when the first worm gear 208 mounted on the output axis 207 is engaged with the first worm wheel 209*b* of the pivot stopper 209, it is rotated to make the pivot stopper 209 slide in the direction opposed to the toner bottle insertion direction.

The driving force from the drive transmission portion 201 is transmitted to the output axis 207, the first idler gear 210, the second idler gear 211 and the shutter sliding gear 212. In addition, as illustrated in FIG. 5B, when the second worm gear 212*a* and the second worm wheel 213*b* are engaged, the shutter slider 213 slides in the direction opposed to the toner bottle insertion direction by the driving force.

When the shutter slider 213 is located at the second position illustrated in FIGS. 3A and 3B, the slider locking portion 213*c* is locked with the slider stopping portion 215*a* protruding from the bottom of the replenishing base 215, and thereby the movement of the shutter slider 213 in the toner bottle insertion direction is stopped. At this time, the slider locking portion 213*c* is not ridden on the slider stopping portion 215*a* illustrated in FIG. 5B, thereby the second worm wheel 213*b* is not meshed with the second worm gear 212*a*. Therefore, at the position illustrated in FIGS. 3A and 3B, the driving force from motor 200 is not transmitted to the second worm wheel 213*b* through the first worm gear 208 and the like.

Figure 4C:
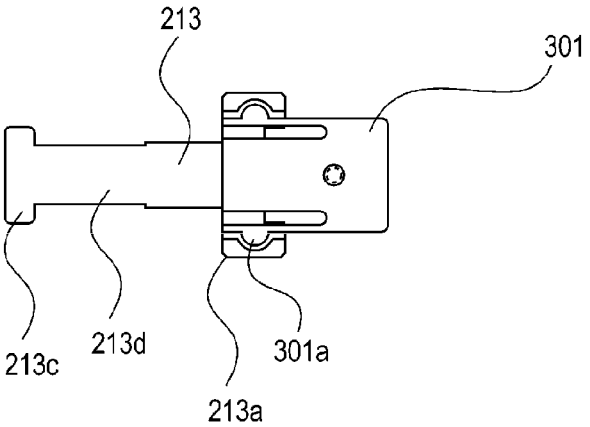
FIG. 4C is a plan view illustrating the engagement of a shutter with a shutter slider.

Moreover, the shutter slider 213 is assembled at the first position illustrated in FIGS. 5A and 5B during assembly of the apparatus. During this assembly work, as illustrated in FIG. 5B, the slider locking portion 213*c* of the shutter slider 213 is assembled in a state ridden on the slider stopping portion 215*a* protruding from the bottom of the replenishing base 215. Therefore, the second worm wheel 213*b* disposed on the bottom of the shutter slider 213 is meshed with the second worm gear 212*a*. Since the slider locking portion 213*c* is connected to a slider elastic portion 213*d* as illustrated in FIG. 4C, it becomes a state ridden on the slider stopping portion 215*a* by the elastic deformation of the slider elastic portion 213*d*. Therefore, in this configuration, a force (restoring force) for the slider elastic portion 213*d* to return to the original position acts on the slider locking portion 213*c*. Therefore, an elastic member is separately disposed to obtain an effect similar to the case of applying a force to the slider locking portion.

The drive mount 214 holds the output axis 207 (the first idler gear 210), the second idler gear 211 and the shutter sliding gear 212.

The drive transmission portion 201 rotatably holds the first output gear 202 and the output axis 207, and transmits the driving force thereto. Further, the drive transmission portion 201 pivotably holds the pivot arm 206, holds the pivot stopper 209 slidably in the axial direction of the output axis 207, and rotatably holds the output coupling 205 and the first output gear 202.

Next, the operation of the respective portions of the toner replenishing apparatus will be described by classifying into (mounting the toner bottle on the body) at the time of apparatus shipment, (starting operation) at the time of apparatus installation, (discharge port communication) at the time of apparatus installation, and (toner bottle operation) at the time of apparatus installation in this order.

(At the Time of Apparatus Shipment (Mounting of Toner Bottle on Body))

The present embodiment attains a configuration in which toner is not fed (toner does not come out) from the toner bottle 100 even with the toner bottle 100 mounted (packaged together) on the apparatus body at the time of apparatus shipment. Specifically, at the time of apparatus shipment, the shutter slider 213 is located at the first position (see FIGS. 5A and 5B) different from the second position (see FIGS. 3A and 3B) of normal use. The first position is a position which allows the shutter 301 to close the discharge port 300*a* when the toner bottle 100 is mounted on the apparatus body. Therefore, when the toner bottle 100 is mounted on the apparatus body, sealing of the toner bottle 100 is attained by controlling the slide rate of the shutter 301. This will be described in detail below.

As illustrated in FIGS. 5A and 5B, the shutter slider 213 is disposed slidably in the toner bottle attaching and detaching direction with respect to the bottle mount 101, and during assembly work of the apparatus, it is assembled in a state closest to downstream in the toner bottle insertion direction (the right direction in the drawing). Further, during assembly work, the shutter slider 213 is assembled in a state in which the slider locking portion 213*c* is ridden on the slider stopping portion 215*a* by elastic deformation of the slider elastic portion 213*d*. Therefore, the second worm wheel 213*b* of the shutter slider 213 is engaged with the second worm gear 212*a* of the shutter moving mechanism, which makes it possible to transmit the driving force therebetween. Similarly, during assembly work, the pivot stopper 209 is also assembled in a state closest to downstream in the toner bottle insertion direction (the right direction in the drawing). Therefore, the first worm wheel 209*b* of the pivot stopper 209 is engaged with the first worm gear 208, which makes it possible to transmit the driving force therebetween. Further, in this state, the pivot stopping portion 209*a* of the pivot stopper 209 is engaged with the pivot locking portion 206*a* of the pivot arm 206, so that the pivoting of the pivot arm 206 is stopped in a state in which the pivot gear 203 is disconnected from the second output gear 204. In addition, the second worm gear 212*a* and the second worm wheel 213*b* are meshed, and the first worm gear 208 and the first worm wheel 209*b* are meshed, and the shutter slider 213 and the pivot stopper 209 maintain the above-described position (the first position illustrated in FIGS. 5A and 5B) without being affected by an external force, by sliding resistance of the drive transmission portion 201 and the rotational resistance of the motor 200.

Figure 6A:
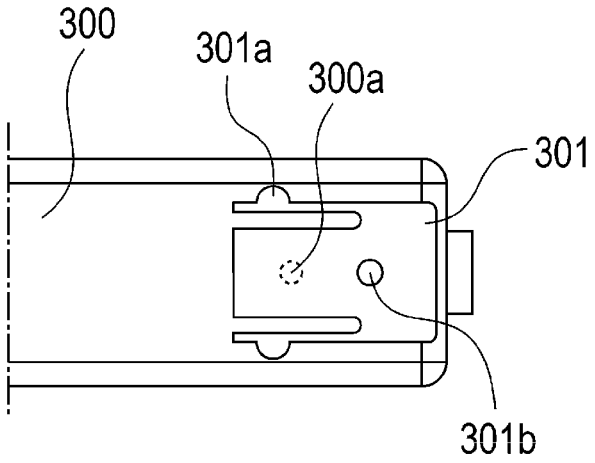
FIGS. 6A and 6B are bottom views of major portions of the toner replenishing apparatus.
Figure 6B:
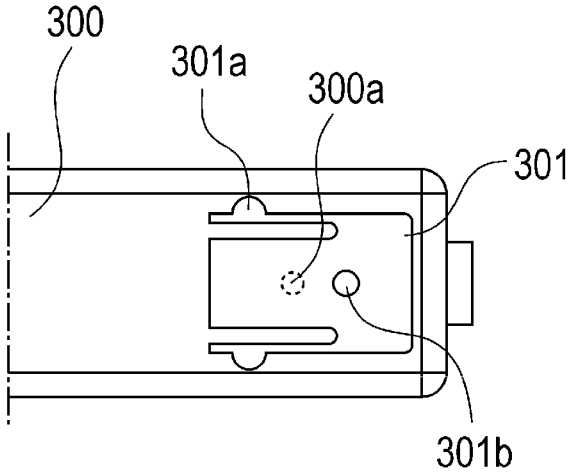

Meanwhile, in the toner bottle 100 mounted on the apparatus body, since the shutter 301 is located at the position illustrated in FIG. 6A, the toner in the toner bottle 100 is sealed by the shutter 301, so as to prevent the toner from leaking to the outside thereof.

The toner bottle 100 is inserted and mounted on the apparatus body in the above-described state. If the insertion of the toner bottle 100 is started, in the process, the shutter locking portion 301*a* of the shutter 301 located at the position illustrated in FIG. 6A is engaged with the shutter stopping portion 213*a* of the shutter slider 213 located at the first position illustrated in FIGS. 5A and 5B, as illustrated in FIG. 4C. When the toner bottle 100 is further inserted, since the shutter locking portion 301*a* is engaged with the shutter stopping portion 213*a*, the shutter 301 is slid relative to the insertion of the toner bottle 100, in a state in which the shutter 301 is stopped by the shutter slider 213 located at the first position. If the toner bottle 100 is inserted to the mounting position (the position illustrated in FIG. 2B), since the shutter slider 213 is at the position illustrated in FIG. 5A, the shutter 301 is slid to the position illustrated in FIG. 6B from the position illustrated in FIG. 6A. At all positions illustrated in FIGS. 6A and 6B, since the communication port 301*b* of the shutter 301 does not communicate with the toner discharge port 300*a* formed in the bottle case 300, the sealed state of the toner bottle 100 is maintained.

As described above, by the position of the shutter slider 213 (the shutter stopping portion 213*a*), the slide rate of the shutter 301 at the time of mounting the toner bottle becomes smaller than the slide rate necessary for the discharge port 300*a* of the bottle case 300 to communicate with the communication port 301*b* of the shutter 301. That is, as illustrated in FIGS. 5A and 5B, the shutter slider 213 assembled at the first position during assembly of the apparatus allows the shutter 301 to be located at the closed position in which the discharge port 300*a* is closed by the shutter, when the toner bottle 100 is mounted on the apparatus body. In this state, since the toner is not discharged by vibration to the toner replenishing pipe 103 side, it is possible to ship the toner bottle 100 in a state mounted on the body.

(At the Time of Apparatus Installation 1 (Starting of Operation))

In the present embodiment, by operating the motor 200 of the toner bottle 100 when starting the use of the apparatus (at the time of apparatus installation) in an above-described shipment state, it is possible to replenish toner from the mounted toner bottle 100. Specifically, when the apparatus is installed and operating, if the motor 200 is driven to start replenishing the toner from the toner bottle 100, the shutter slider 213 (the shutter stopping portion 213*a*, the shutter 301) is moved so that the discharge port 300*a* of the bottle case 300 communicates with the communication port 301*b* of the shutter 301, as illustrated in FIG. 4A. Thereafter, the driving is transmitted to the toner bottle 100. This will be described in detail below.

If the motor 200 is driven in a state illustrated in FIGS. 5A and 5B, a driving force is transmitted to the first output gear 202 and the output axis 207 through the drive transmission portion 201. In this state, the pivot stopper 209 is closest to downstream in the toner bottle insertion direction (the right direction in the drawing). Therefore, the pivot stopping portion 209*a* of the pivot stopper 209 is engaged with the pivot locking portion 206*a* of the pivot arm 206 so as to stop the pivoting of the pivot arm 206, and the driving force being transmitted to the pivot gear 203 from the first output gear 202 is not transmitted to the second output gear 204. Consequently, a discharging force does not act on the toner of the toner bottle 100. At this time, the pivot motion (revolution) of the pivot gear 203 is regulated by the pivot stopper 209, while maintaining the position and rotating (rotation) by the driving force from the first output gear 202. Although the pivot gear 203 receives a force in the pivot direction by the frictional force applied when the first output gear 202 is driven, the pivoting force is relatively small. Therefore, the pivot stopper 209 is not damaged even if the driving force is inputted into the pivot gear 203, in a state in which the pivot stopper 209 holds the pivot gear 203 at the holding position.

Meanwhile, the driving force from the output axis 207 is transmitted to the first worm gear 208 and the first worm wheel 209*b*, and the pivot stopper 209 starts to move in the direction upstream in the toner bottle insertion direction (the left direction in the drawing). However, movement only was started, but the pivot stopping portion 209*a* of the pivot stopper 209 and the pivot locking portion 206*a* of the pivot arm 206 are still engaged. Therefore, the driving is not transmitted to the toner bottle 100, and the toner bottle 100 is maintained in a state of not being acted on by the discharge force.

The driving force of the output axis 207 is also transmitted to the shutter sliding gear 212 through the first idler gear 210 and the second idler gear 211. Since the second worm gear 212*a* of the shutter sliding gear 212 and the second worm wheel 213*b* of the shutter slider 213 are meshed with each other, the shutter slider 213 starts moving upstream in the toner bottle insertion direction (the left direction in the drawing). However, since movement only has started but the discharge port 300*a* of the bottle case 300 and the communication port 301*b* of the shutter 301 are not overlapped, the sealing state of the toner bottle 100 is maintained.

(At the Time of Apparatus Installation 2 (Communication of Discharge Port))

Figure 7A:
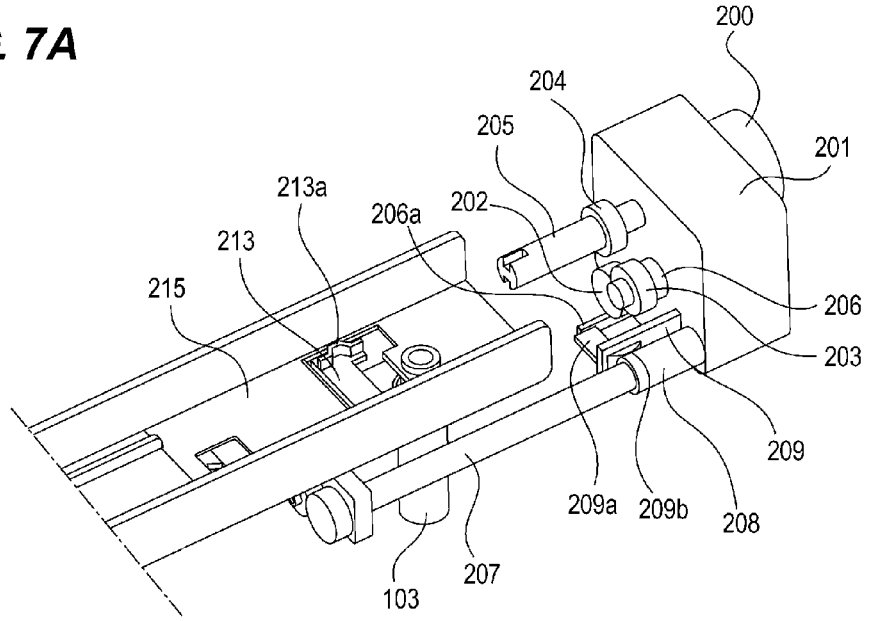
FIGS. 7A and 7B are perspective views of the major portions of the toner replenishing apparatus.
Figure 7B:
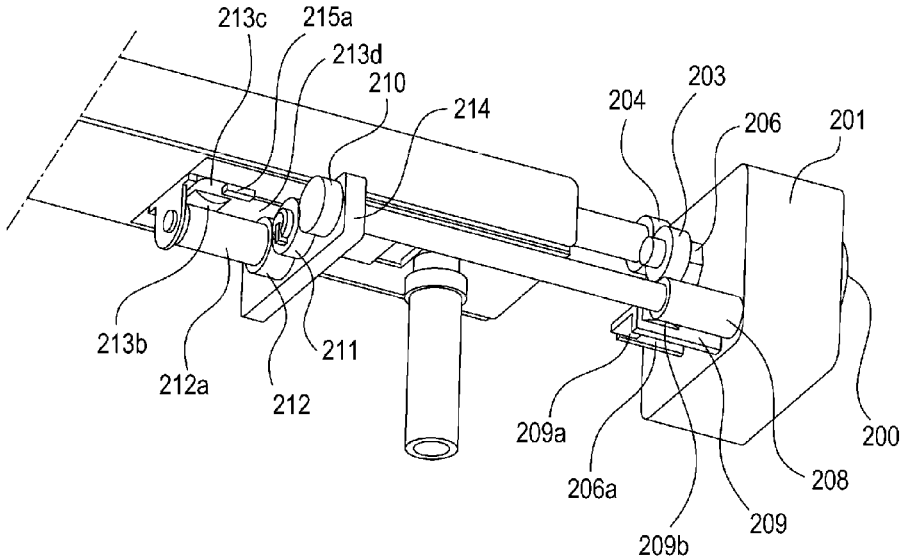

If the motor 200 is driven continuously, the shutter slider 213 is moved in the direction opposed to the toner bottle insertion direction, and thereby the shutter 301 of the toner bottle 100 engaged with the shutter slider 213 is also moved together in the same direction. By this movement, as illustrated in FIG. 4A, the discharge port 300*a* of the bottle case 300 mounted and fixed on the bottle mount and the communication port 301*b* of the shutter 301 which was moved together with the shutter slider 213 are overlapped so as to be a position communicating with each other. At this timing, as illustrated in FIGS. 7A and 7B, the slider locking portion 213*c* of the shutter slider 213 which was overlapped and ridden on the slider stopping portion 215*a* of the bottom of the replenishing base becomes not overlapped with the slider stopping portion 215*a*, and is moved upward in the drawing by the restoring force of the slider elastic portion 213*d*, and therefore, movement thereof in the insertion direction is stopped by the slider stopping portion 215*a*, so that the shutter slider 213 may be positioned. At the same time, since the second worm wheel 213*b* of the shutter slider 213 is disengaged from the second worm gear 212*a*, the driving force is not transmitted to the shutter slider 213. The position of the shutter slider 213 in this state becomes a normal position in which the shutter slider 213 is located in the same position as when the apparatus is normally used. This position is a second position in which the shutter opens and closes the discharge port along with the operation of attaching and detaching the toner bottle to and from the apparatus body. That is, the shutter slider 213 is at the position in which the sealing of the shutter 301 is released by the insertion operation of the toner bottle 100, and is at the position in which the discharge port is sealed by the shutter 301 by the operation of drawing out the toner bottle 100.

In the above-described state, the discharge port 300*a* of the bottle case 300 communicates with the communication port 301*b* of the shutter 301 so that the toner can be discharged from the toner bottle 100. However, in this timing, as illustrated in FIGS. 7A and 7B, even while the pivot stopper 209 is moved in the direction opposed to the toner bottle insertion direction, the pivot stopping portion 209*a* is maintained in a state engaged with the pivot locking portion 206*a* of the pivot arm 206. Therefore, as described before, at the point of time when the shutter slider 213 is moved to the second position, the driving is not yet transmitted to the toner bottle 100, thereby the discharging force does not act on the toner.

(At the Time of Apparatus Installation 3 (Driving of Toner Bottle))

When the motor 200 is driven continuously, as illustrated in FIGS. 3A and 3B, the pivot stopper 209 is moved in the direction opposed to the toner bottle insertion direction (the left direction in the drawing), and therefore, the pivot stopping portion 209*a* of the pivot stopper 209 and the pivot locking portion 206*a* of the pivot arm 206 are disengaged. Therefore, the pivot arm 206 can be pivoted, and the pivot arm 206 is pivoted to the drive transmission position illustrated in FIGS. 2A, 2B, 3A, and 3B by the driving force transmitted to the pivot gear 203 from the first output gear 202, and the pivot gear 203 and the second output gear 204 are engaged, so that the driving force starts to be transmitted to the toner bottle 100. Since the discharge port 300*a* of the bottle case 300 and the communication port 301*b* of the shutter 301 already communicate with each other, it is possible to replenish the toner from the toner bottle 100.

Thereafter, since the pivot stopper 209 is further moved in the direction opposed to the toner bottle insertion direction (the left direction in the drawing) by the driving force for the toner replenishment, the first worm wheel 209*b* of the pivot stopper 209 and the first worm gear 208 are disengaged. Since the driving force is not transmitted to the first worm wheel 209*b* from the first worm gear 208 during disengaging, the burden of the driving force is reduced.

At this stage, work of communicating between the discharge port 300*a* of the bottle case 300 and the communication port 301*b* of the shutter 301 is completed, and the motor 200 starts operation, so that normal toner replenishment from the toner bottle 100 is made possible.

As described above, according to the present embodiment, by the shutter slider 213 which is movable to the first position and the second position, sealing of the toner bottle by the shutter in a state mounted on the apparatus body and opening and closing of the toner bottle by the apparatus body become possible. Therefore, size-up of the apparatus or increase of costs is not brought about, and shipment (transportation) with the bottle mounted on the body is made possible, and further, toner scattering or leakage can be prevented.

Further, as described above, by positional relations between the pivot stopping portion 209*a* and the pivot locking portion 206*a*, and the slider stopping portion 215*a* and the slider locking portion 213*c*, the driving force starts to be transmitted to the toner bottle 100, after the discharge port 300*a* of the bottle case 300 communicates with the communication port 301*b* of the shutter 301. Therefore, the discharging force does not act on the toner bottle 100 during communication work of the discharge port 300*a* of the bottle case 300 and the communication port 301*b* of the shutter 301, and the discharging force acts on the toner bottle 100 after they reliably communicate with each other. Therefore, it is possible to minimize contamination of the toner in the shutter portion.

Further, as described above, the present embodiment has a configuration in which the discharge port 300*a* of the bottle case 300 communicates with the communication port 301*b* of the shutter 301 as the shutter slider 213 slides to the normal position (the second position illustrated in FIGS. 3A and 3B). Therefore, after the shutter slider 213 is moved to the normal position, the shutter 301 is opened and closed by the attaching and detaching of the toner bottle 100. Therefore, according to the configuration of the present embodiment, opening and closing of the shutter 301 are not affected by the attaching and detaching of the toner bottle during normal use, and good operability can be maintained.

Further, as described above, in the present embodiment, the driving source for driving the toner bottle 100 is the same as the driving source (the motor 200) for driving the shutter slider 213. That is, since the driving source of the toner bottle is used to open the shutter, a new driving source is not needed, and the cost increase for the body may be reduced further. However, the present invention is not limited thereto, and it is possible to attain the configuration of the present patent without problems also when using another driving source.

Further, because the shutter provided in the toner bottle is used when sealing the toner bottle to the apparatus body, and it is not necessary to provide the apparatus body with a new shutter, it is difficult for the toner to leak in the configuration.

Second Embodiment

Regarding Image Forming Apparatus

Figure 8:
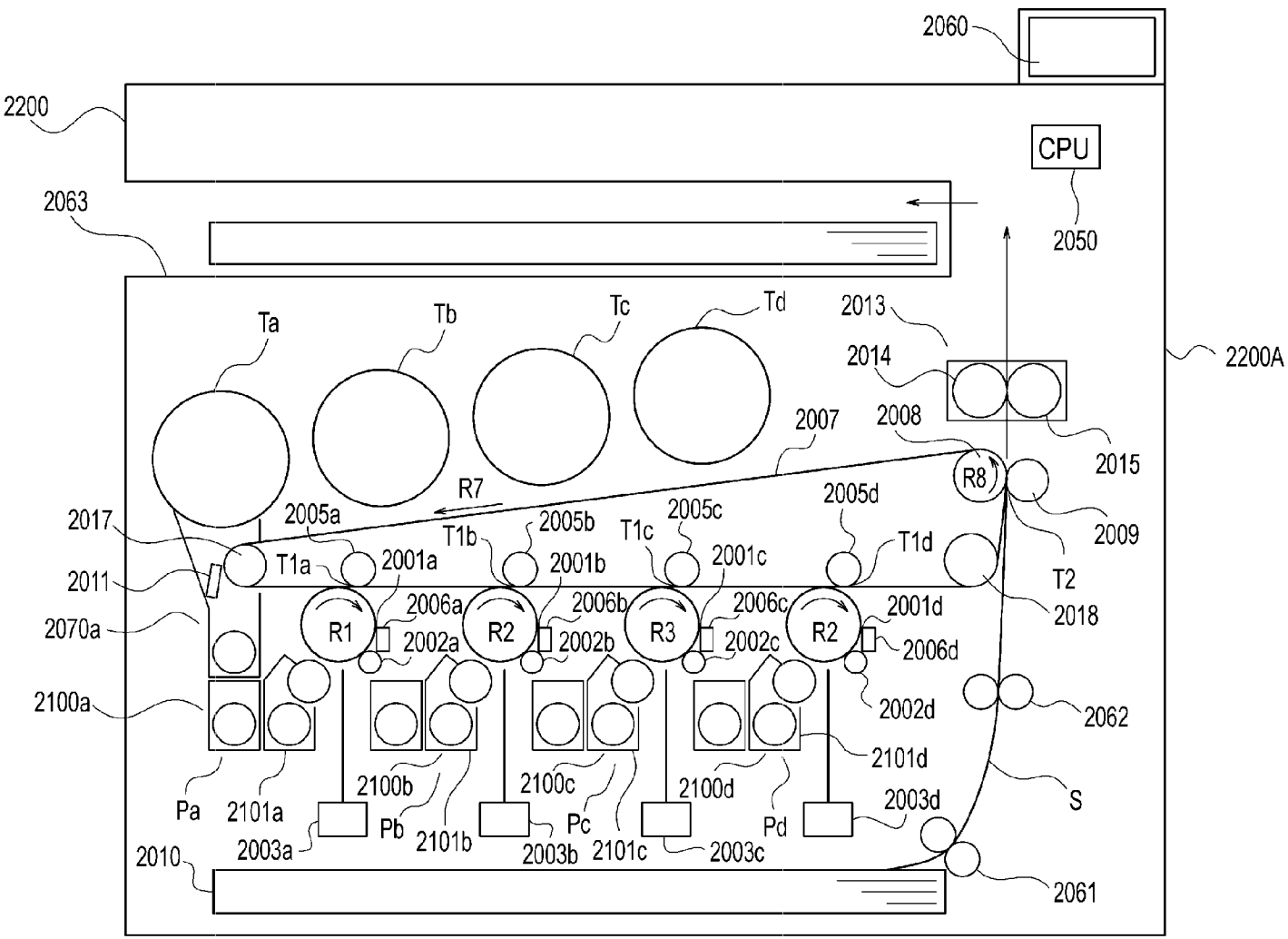
FIG. 8 is a cross-sectional view of a color image forming apparatus using an electrophotographic system.

An image forming apparatus 2200 according to the present invention will be described. FIG. 8 is a cross-sectional view of a color image forming apparatus using an electrophotographic system. The image forming apparatus 2200 is a so-called intermediate transfer tandem type image forming apparatus, in which four color forming portions are arranged in parallel on an intermediate transfer belt 2007. The intermediate transfer tandem method is a configuration that makes a main stream recently in view of the fact that it can deal with high productivity and various media carriers. Moreover, the direction perpendicular to ground in FIG. 8 is the front to back direction.

<Conveying Process of Recording Material>

Recording materials S are stored in a form loaded on a storage tray 2010, and are dispatched on image forming timing by a feeding roller 2061 using a friction separation method. The recording material S sent out by the feeding roller 2061 passes through a conveying path and is conveyed on registration roller 2062. After skew feeding correction or timing correction is carried out on the registration roller 2062, the recording material S is sent to a secondary transfer portion T2. The secondary transfer portion T2 is a transfer nip portion formed a secondary transfer inner roller 2008 and a secondary transfer outer roller 2009 which are facing each other, and adsorbs a toner image on recording material S by applying a predetermined pressing force and electrostatic load bias.

<Image Forming Process>

A process of forming the image sent to the secondary transfer portion T2 at the same timing will be described, in relation to the above-described process of the conveying recording material S to the secondary transfer portion T2. Generally, the image forming portions Pa to Pd include photosensitive drums 2001*a* to 2001*d*, charging apparatuses 2002*a* to 2002*d*, exposing apparatuses 2003*a* to 2003*d*, developing apparatuses 2100*a* to 2100*d*, developing containers 2101*a* to 2101*d*, primary transfer rollers 2005*a* to 2005*d* and photosensitive cleaners 2006*a* to 2006*d* and the like.

When exposing apparatuses 2003*a* to 2003*d* are driven based on a signal of the sent image information, electrostatic images are formed on photosensitive drums 2001*a* to 2001*d*, each of which has a surface uniformly charged in advance by charging apparatuses 2002*a* to 2002*d* and is rotated by a development driving apparatus (not illustrated), while appropriately passing through diffracting portions.

Next, the electrostatic image formed on each of the photosensitive drums 2001*a* to 2001*d* goes through toner development by developing apparatuses 2100*a* to 2100*d* and appears as a toner image. Thereafter, a predetermined pressing force and electrostatic load bias are applied by primary transfer rollers 2005*a* to 2005*d* and the toner image is transferred on the intermediate transfer belt 2007. Lastly, the small amount of transfer residual toner remaining on the photosensitive drums 2001*a* to 2001*d* is recovered by the photosensitive cleaners 2006*a* to 2006*d*, and again, the image forming portions prepare for the next image forming process.

Moreover, when the toner quantity in the developing apparatuses 2100*a* to 2100*d* is lowered, toner is fed from corresponding storage containers (the toner storage containers) Ta to Td (Tb to Td have the same shape as Ta). At this time, since replenishing apparatuses 2070*a* to 2070*d* (2070*b* to 2070*d* have the same shape as 2070*a*) are formed to have the same shape, the replenishing apparatuses 2070*a* to 2070*d* will be briefly referred to as 2070. Moreover, the replenishing apparatuses 2070*b* to 2070*d* will be omitted from FIG. 8. The subscript corresponds to the subscript of the developing apparatus. The replenishing apparatuses are driven in synchronization with the corresponding developing apparatuses 2100*a* to 2100*d* to replenish toner. The replenishing operation will be described below.

Figure 11:
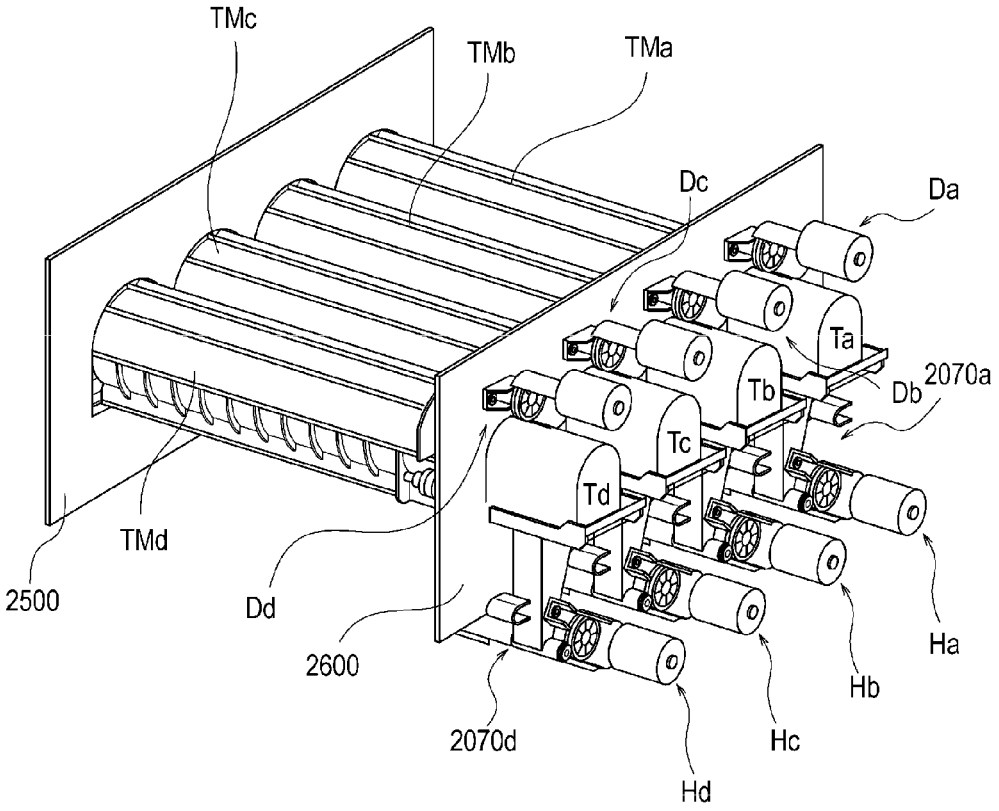
FIG. 11 is a top perspective view illustrating an internal configuration of an apparatus body.

Herein, as illustrated in FIG. 11, the storage containers Ta to Td (see FIG. 8) are stored and held respectively in holding members TMa to TMd suspended between a front plate 2500 and a rear plate 2600, and the holding members TMa to TMd are suspended independently between the front plate 2500 and the rear plate 2600 respectively. Further, the development driving apparatus is fastened and installed on the rear plate 2600.

In the above-described image forming portions Pa to Pd in FIG. 8, four sets of yellow (Y), magenta (M), cyan (C) and black (Bk) exist. However, the number of colors is not limited to four colors, and the sequence of colors is not limited thereto. Further, the developing containers 2101*a* to 2101*d* store two-component developer in which non-magnetic toner and magnetic carrier are mixed in advance, but one-component developer of a magnetic toner or a non-magnetic toner may be used. In the present embodiment, the case of two-component developer (initial developer) being stored will be described.

Next, the intermediate transfer belt 2007 will be described with reference to FIG. 8. The intermediate transfer belt 2007 is installed in an intermediate transfer belt frame (not illustrated), and is stretched by the secondary transfer inner roller 2008 combining with a drive transmission portion to the intermediate transfer belt 2007, a tension roller 2017 and a secondary transfer upstream roller 2018. When the secondary transfer inner roller 2008 is driven in a direction of an arrow R8, the intermediate transfer belt 2007 is driven in a direction of an arrow R7. The intermediate transfer belt 2007 is an endless belt.

Each color image forming process, which is processed in parallel by the image forming portions Pa to Pd of Y, M, C and Bk, is carried out at sequentially overlapped timing on the upstream color toner image which is primary-transferred on the intermediate transfer belt 2007. As a result, finally, a full-color toner image is formed on the intermediate transfer belt 2007, and the recording material is conveyed to the secondary transfer portion T2. Moreover, the transfer residual toner, which has passed through secondary transfer portion T2, is recovered by the transfer cleaner apparatus 2011.

<Process after Secondary Transfer>

By the conveying process and image forming process described above respectively, the timing of the recording material S and full-color toner image are matched, so that secondary transfer is carried out in the secondary transfer portion T2. Thereafter, the recording material S is conveyed to a fixing apparatus 2013. The fixing apparatus 2013 dissolves and fixes the toner image to the recording material S by applying a predetermined pressure and quantity of heat to the recording material S passing through it, in the fixing nip formed by a roller facing thereto.

Therefore, the fixing apparatus 2013 includes a heater which is a heat source to be controlled so as to maintain optimum temperature at all times. In case the recording material S which is image-fixed like above is discharged onto a sheet discharge tray 2063 or a double-sided image forming is needed, path selection whether to be conveyed to an inverse conveying apparatus (not illustrated) is executed.

<Storage Container T>

Next, storage containers Ta to Td held in the holding members TMa to TMd (since all the containers have the same shape, the containers will be referred to as TM hereinafter) will be described with reference to FIGS. 9A and 9B.

Figure 9A:
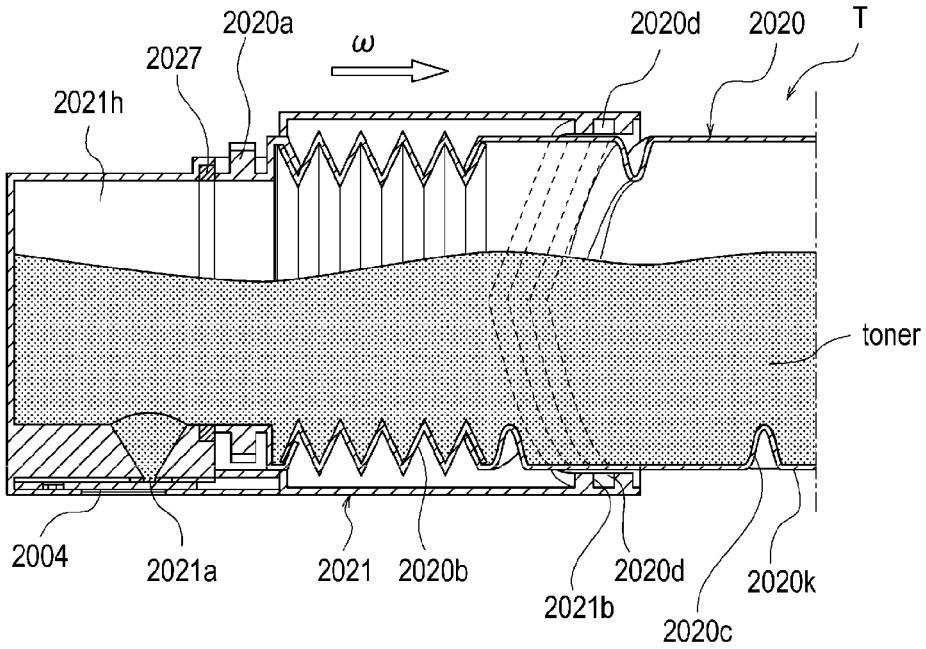
FIGS. 9A and 9B are cross-sectional views of a storage container.
Figure 9B:
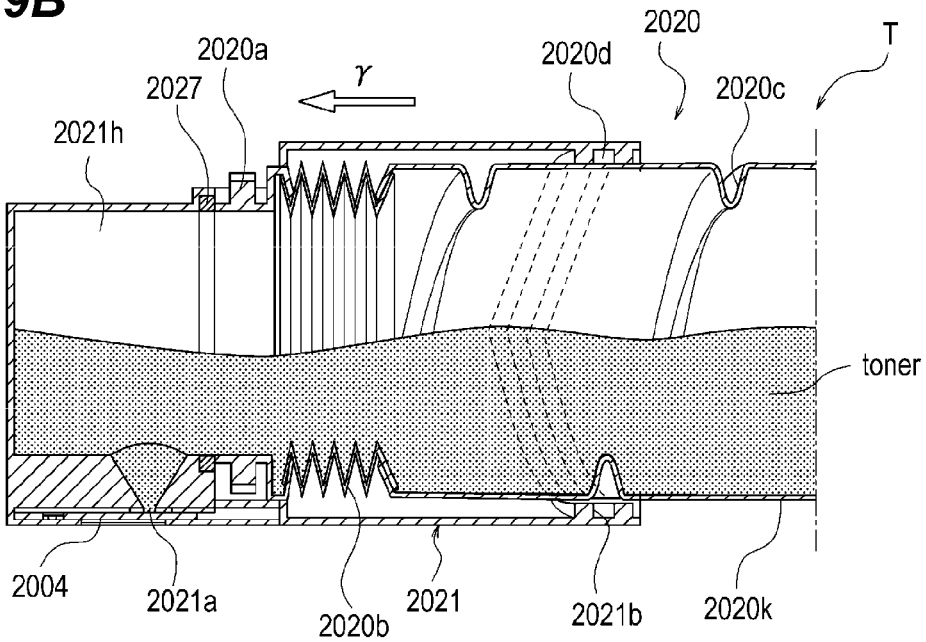

The storage container T which stores toner is formed to have a hollow cylinder shape and includes a toner storing portion 2020 having a space for storing toner therein (illustrated as toner in FIGS. 9A and 9B). Further, the storage container T has a flange portion 2021 (which will also be referred to as a non-rotating portion) on one end side thereof in a longitudinal direction (developer conveying direction) of the toner storing portion 2020. Further the toner storing portion 2020 is configured to be rotatable relative to the flange portion 2021.

The flange portion 2021 is provided with a hollow discharge portion 2021*h* for temporarily storing the toner conveyed from inside the toner storing portion 2020, as illustrated in FIG. 9B. The discharge portion 2021*h* includes a small discharge port 2021*a* which is formed on the bottom thereof to allow discharge of the toner out of the storage container T, that is, to replenish the toner to a replenishing apparatus 2070 (see FIG. 8). Further, a shutter 2004 which opens and closes the discharge port 2021*a* is installed inside the flange portion 2021. The shutter 2004, which is a 'sealing portion', seals the toner discharge port 2021*a* formed in the storage container T. Operation of the shutter 2004 will be described below.

A pump portion 2020*b* of the present embodiment functions as a ventilator which carries out air intake and exhaust operations alternately through the discharge port 21*a*. As illustrated in FIG. 9B, the pump portion 2020*b* installed between a discharge portion 2021*h* and a cylinder portion 2020*k* is connected and fixed to the cylinder portion 2020*k*. That is, the pump portion 2020*b* is integrally rotatable together with the cylinder portion 2020*k*. Further, the pump portion 2020*b* of the present embodiment has a configuration capable to store the toner therein.

In addition, the present embodiment uses a volume variable pump (bellows pump), as the pump portion 2020*b*, which is made of a resin and has a volume variable according to reciprocation (an arrow co and an arrow y indicate movement directions of the pump portion 2020*b*). Specifically, as illustrated in FIGS. 9A and 9B, the pump portion 2020*b* uses a bellows pump in which a plurality of mountain folded portions and valley folded portions are periodically and alternately formed.

Further, as illustrated in FIG. 9B, the pump portion 2020*b* is relative-rotatably fixed with respect to the discharge portion 2021*h*, in a state in which a ring-shaped seal member 2027 installed on an inner surface of the flange portion 2021 is compressed by an end portion of the discharge portion 2021*h* side.

The storage container T is provided with a gear portion 2020*a*. The gear portion 2020*a* is fixed to one end side of the pump portion 2020*b* in the longitudinal direction. That is, the gear portion 2020*a*, the pump portion 2020*b* and the cylinder portion 2020*k* have an integrally rotatable configuration.

Therefore, the storage container T has a structure in which the rotation driving force inputted in the gear portion 2020*a* is transmitted to the cylinder portion 2020*k* (a conveying portion 2020*c*) through the pump portion 2020*b*.

Figure 10:
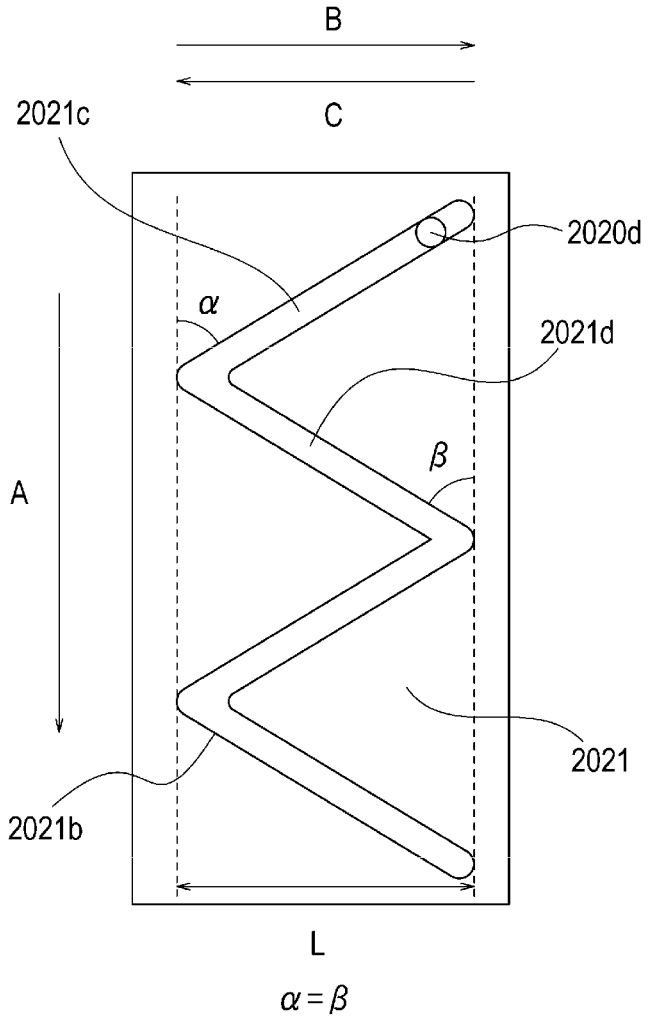
FIG. 10 is a development view of a groove portion.

Meanwhile, a groove portion 2021*b* functioning as a driven portion in which a cam protrusion 2020*d* is fitted is formed all over the inner periphery of the flange portion 2021. The groove portion 2021*b* will be described with reference to FIG. 10. In FIG. 10, an arrow A indicates the rotation direction of the cylinder portion 2020*k* (the movement direction of a cam protrusion 2020*d*), an arrow B the stretch direction of the pump portion 2020*b*, and an arrow C the compression direction of the pump portion 2020*b*, respectively.

Further, the angle forming the groove portion 2021*c* with respect to the rotation direction A of the cylinder portion 2020*k* is referred to as α, and the angle forming the groove portion 2021*d* is referred to as β. In addition, the stretch direction of the pump portion 2020*b* of the groove portion 2021*b* is referred to as B, and the amplitude at C (=the stretch length of the pump portion 2020*b*) is referred to as L.

Specifically, the groove portion 2021*b* has a structure in which the groove portion 2021*c* inclined toward the discharge portion 2021*h* from the cylinder portion 2020*k* side and the groove portion 2021*d* inclined toward the cylinder portion 2020*k* from the discharge portion 2021*h* side are alternately connected, as illustrated in FIG. 10 which unfolds the groove portion 2021*b*. In the present embodiment, setting is α=β.

Therefore, in the present embodiment, the cam protrusion 2020*d* and the groove portion 2021*b* function as a mechanism for transmitting the driving force to the pump portion 2020*b*. That is, the cam protrusion 2020*d* and the groove portion 2021*b* convert the driving force transmitted to the gear portion 2020*a* to a force that reciprocates the pump portion 2020*b* (a force of the cylinder portion 2020*k* in the rotational axis direction), and function as a mechanism for transmitting the converted force to the pump portion 2020*b*.

<Replenishment Configuration>

Figure 12:
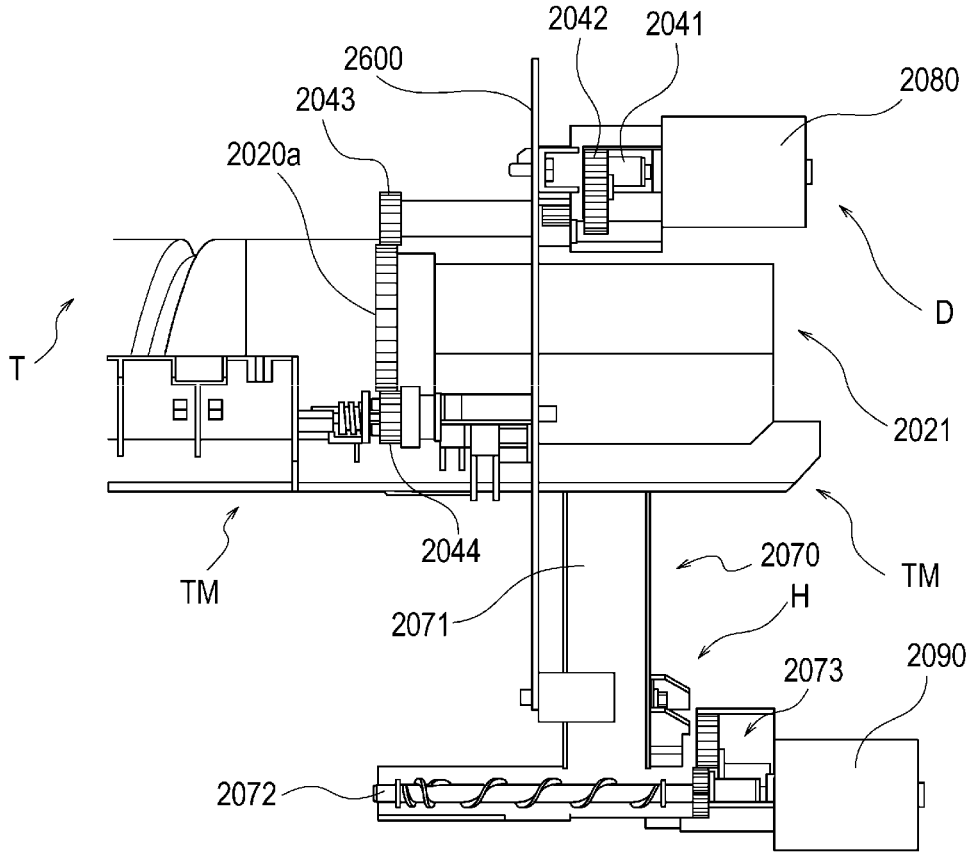
FIG. 12 is a right side view illustrating the internal configuration of the apparatus body.

Next, a replenishment configuration for discharging the toner from the storage container T will be described with reference to FIGS. 11 to 13. FIG. 11 is a top down perspective view of an inside of the apparatus body 2200A, and FIG. 12 is a right side view of the inside of the apparatus body 2200A. The storage container T is detachably housed in the holding member TM which is stretched between the front plate 2500 and the rear plate 2600.

Driving apparatuses (replenishment driving apparatuses) Da to Dd (since Da to Dd have the same shape, Da to Dd will be referred to as D hereinafter) are installed to the rear plate 2600. The driving apparatus D which is a 'driving portion' to transmit a driving force to the storage container T (see FIGS. 12 and 14, which will described below) has a motor 2080 (a bottle driving motor), a gear 2041, a gear 2042, and a gear member 2043, which transmit a driving force of the motor 2080 at a reduced speed. The gear 2041 is mounted on a shaft of the motor 2080, and a first stage gear 2042*a* of the two-stage gear 2042 is meshed with the gear 2041. A gear 2043*a* of the gear member 2043 is meshed with a second stage gear 2042*b* of the two-stage gear 2042. A gear portion 2020*a* formed on an outer periphery of the storage container T is meshed with a gear 2043*b* of the gear member 2043.

Therefore, in the above-described configuration, the driving force of the motor 2080 is transmitted to the gear 2041, the gear 2042, the gear member 2043, and the gear portion 2020*a*. Since the storage container T is driven by the driving of the gear portion 2020*a*, the toner replenishing operation of the storage container T is made possible.

Figure 13:
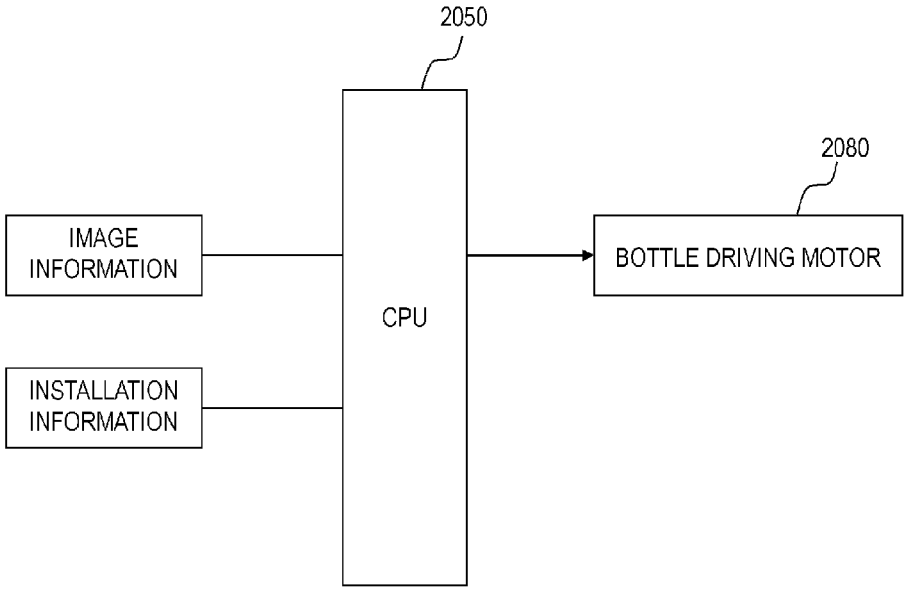
FIG. 13 is a block diagram illustrating a control system of a CPU.

FIG. 13 is a block diagram illustrating a control system of a CPU 2050. As illustrated in FIG. 13, when the CPU 2050 receives image information or installation information on the output recording material S, the CPU 2050 sends rotation timing and rotation time of the motor 2080 thereto. Therefore, a predetermined amount of toner is stably supplied into the replenishing apparatus 2070 from the storage container T. Also, the installation information can be input from an operation portion 2060 of FIG. 8 by a user. That is, the CPU 2050 performs a predetermined initial operation, based on the installation information input from the operation portion 2060. In other words, the CPU 2050 drives a releasing apparatus 2300 to be described below, based on the installation information.

As illustrated in FIG. 12, the replenishing apparatus 2070 (since replenishing apparatuses 2070*a* to 2070*d* have the same shape, the replenishing apparatuses 2070*a* to 2070*d* will be referred to as 2070 hereinafter) has a housing portion 2071, a conveying motor 2090, a screw 2072 drivingly connected to a gear train 2073 and the like. The housing portion 2071 may store toner therein, and when the conveying motor 2090 rotates while engaged with the developing drive apparatus (not illustrated), the toner sent into the replenishing apparatus 2070 is conveyed to the developing apparatus 2100, and thereby the above-described image forming operation is performed.

<Opening and Closing Configuration of Shutter 2004>

Next, an opening and closing configuration of the shutter 2004 of the storage container T having the characteristic configuration of the present embodiment will be described in detail with reference to FIGS. 14 to 19. In this configuration, it is possible to achieve a configuration in which, even in a state that the storage container T is mounted on the apparatus body 2200A at the time of shipment of the image forming apparatus 2200, toner may not be supplied from the storage container T (toner does not leak). Specifically, at the time of shipment, since a slider 2030 (see FIGS. 16A and 16B) is located at a position different from during the normal operation, sealing of the storage container T may be attained by controlling the sliding amount of the shutter 2004 when mounting the storage container T. This will be described in detail below.

Figure 14A:
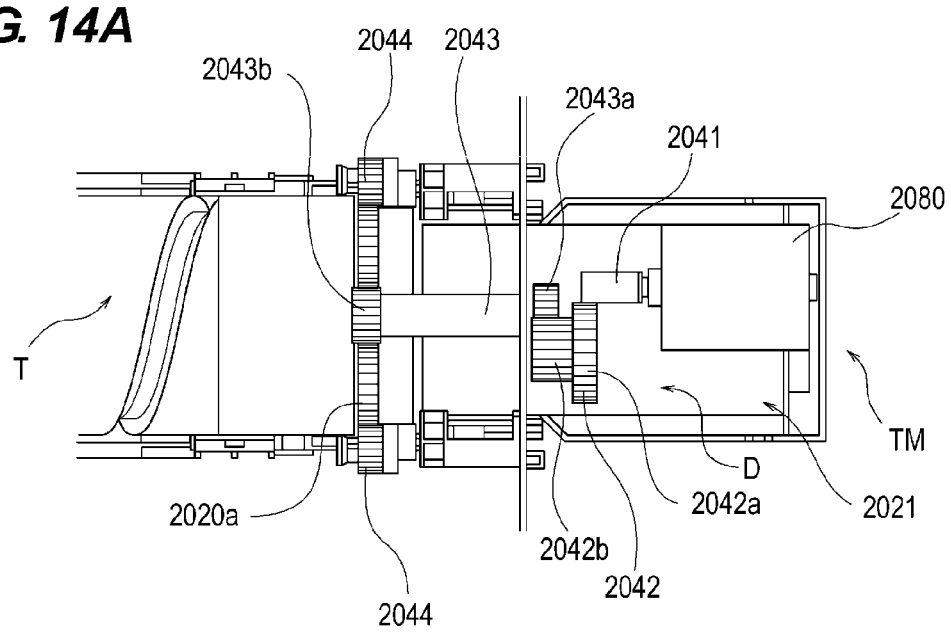
FIGS. 14A and 14B are top views of a state in which the storage container is installed in the apparatus body.
Figure 14B:
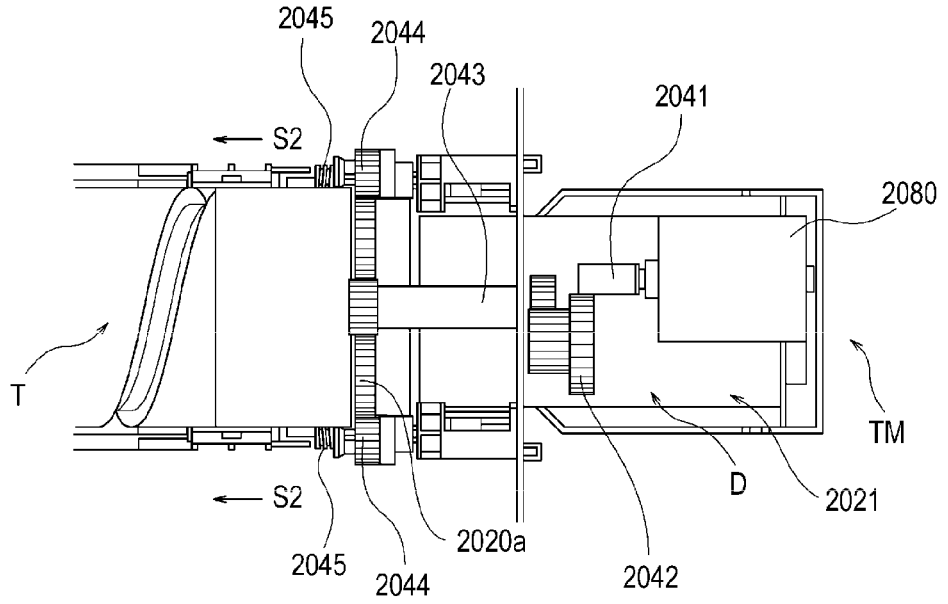
Figure 15A:
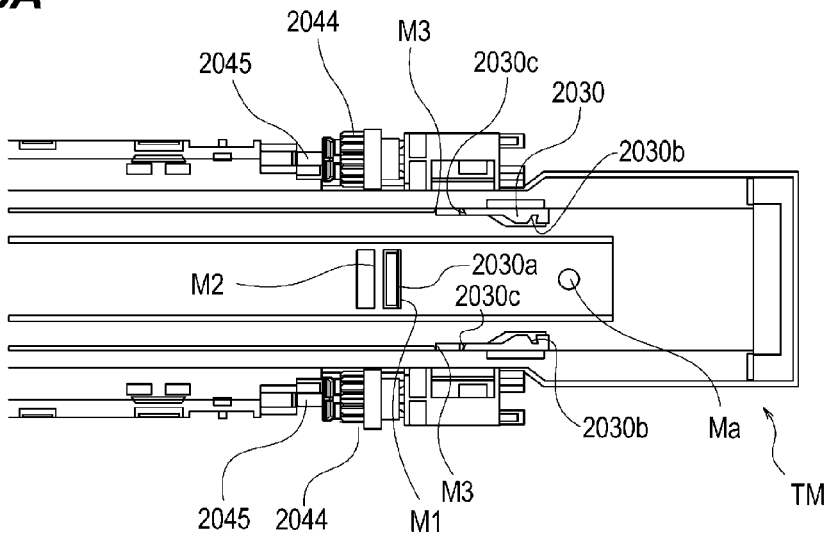
FIGS. 15A and 15B are top views of a state in which the storage container and a driving apparatus are removed from the state of FIG. 14.
Figure 15B:
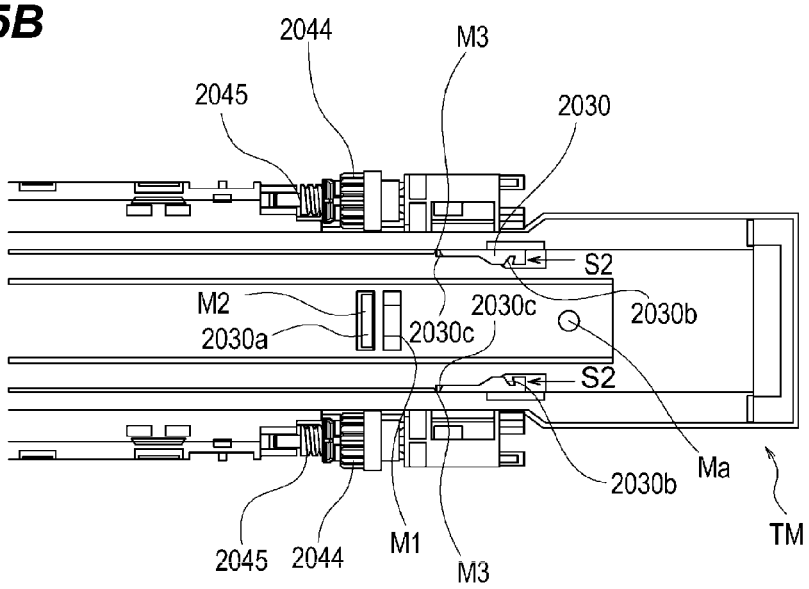
Figure 16A:
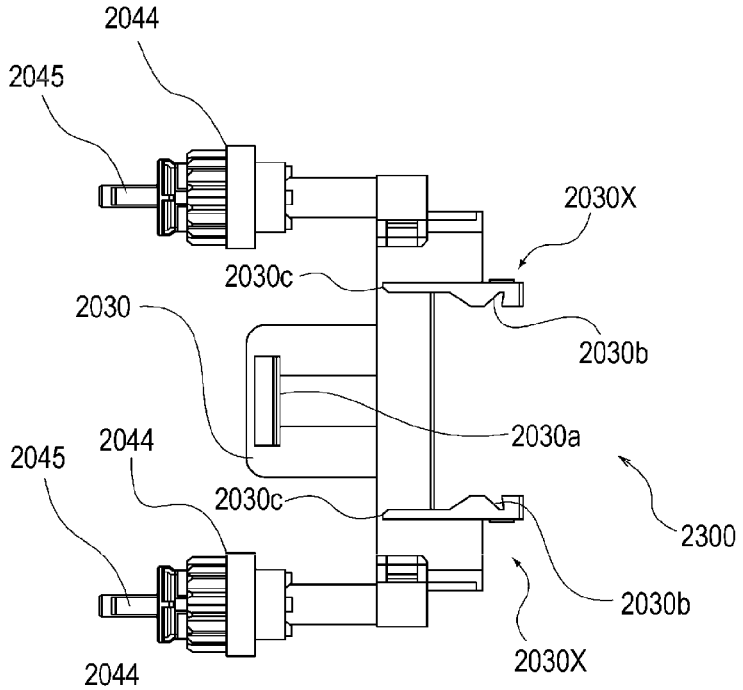
FIGS. 16A and 16B are top views of a releasing apparatus.
Figure 16B:
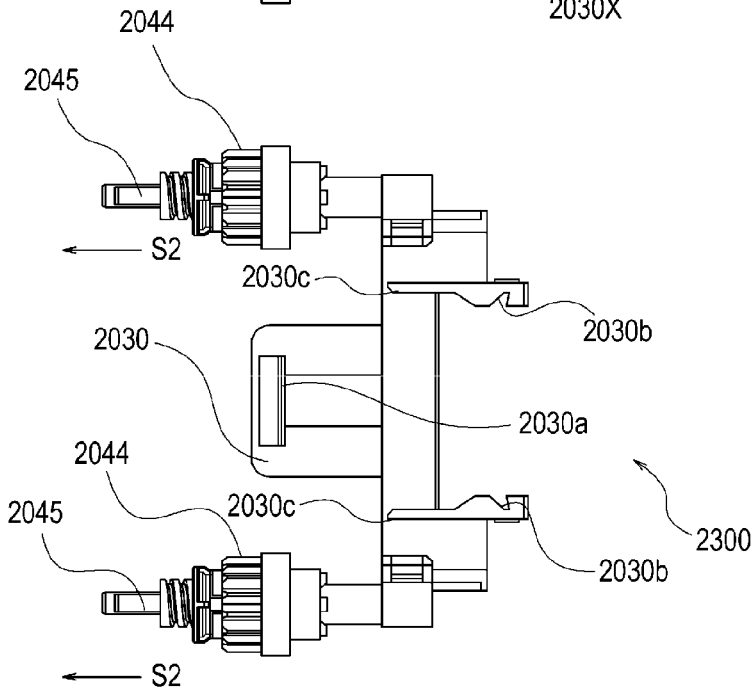
Figure 17A:
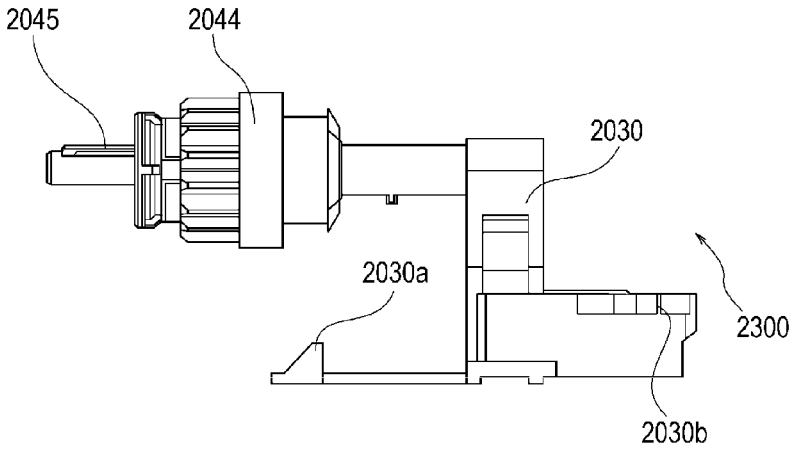
FIGS. 17A and 17B are top views of the releasing apparatus.
Figure 17B:
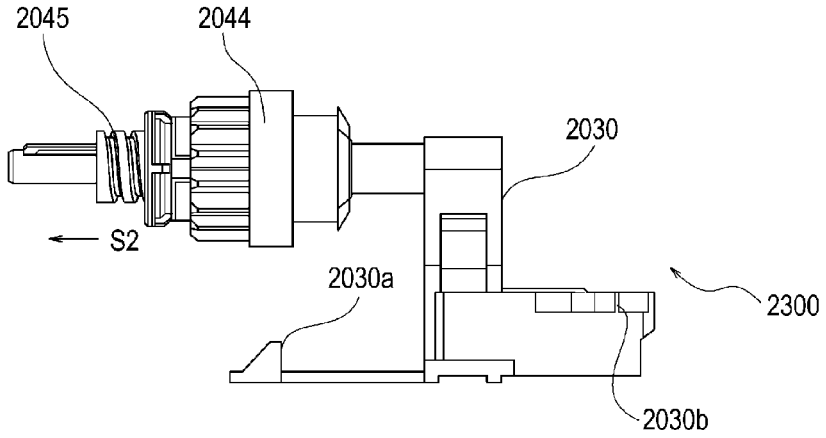
Figure 18:
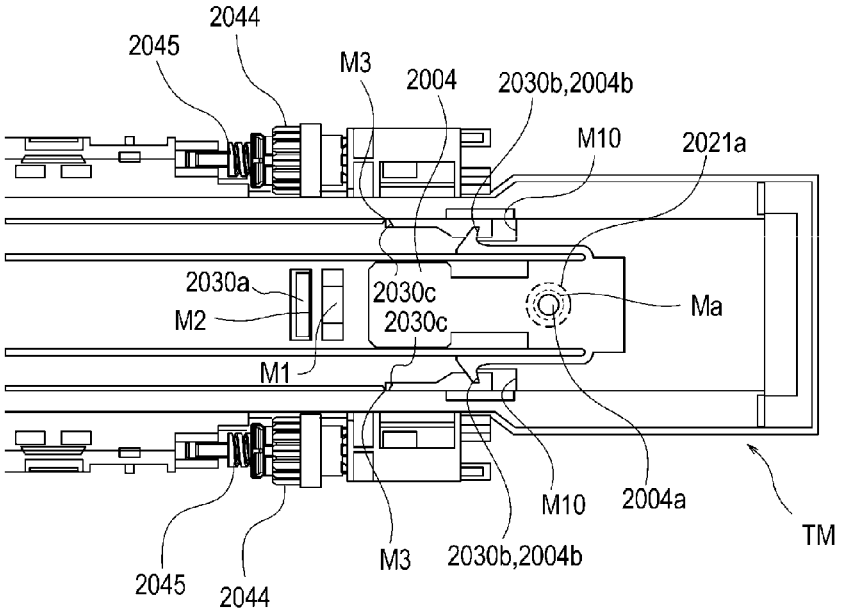
FIG. 18 is a top view illustrating a state in which the shutter is mounted to the state of FIG. 15.
Figure 19A:
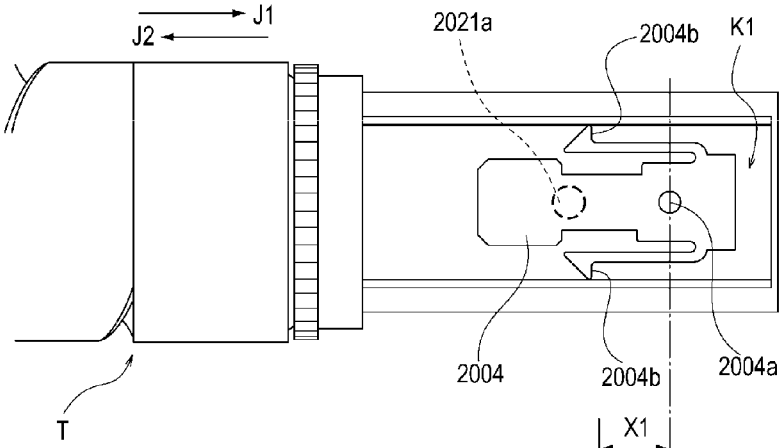
FIGS. 19A, 19B, and 19C are rear views of the storage container.
Figure 19B:
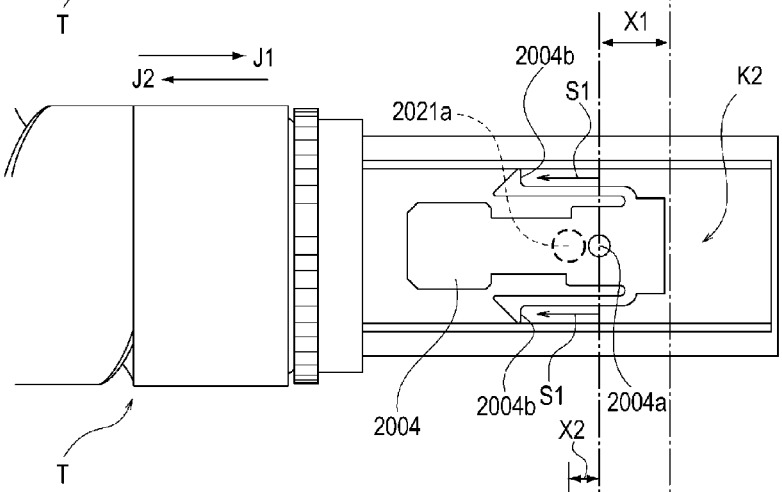
Figure 19C:
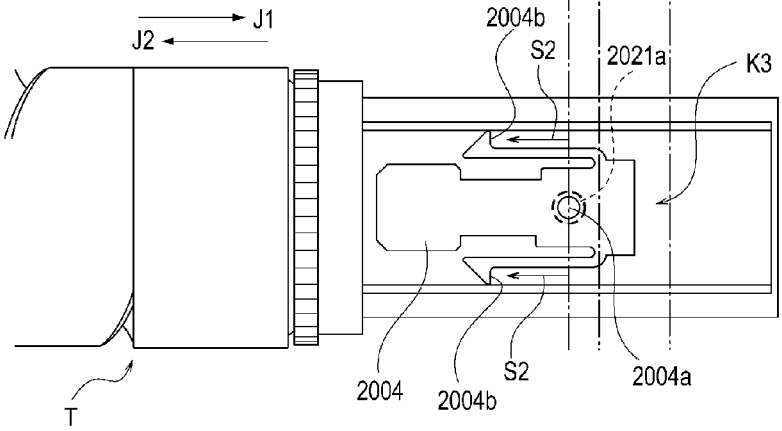

FIGS. 14A and 14B are top views illustrating a state in which the storage container T is installed in the apparatus body 2200A. FIGS. 15A and 15B are top views illustrating a state in which the storage container T and a driving apparatus D are removed from the state of FIGS. 14A and 14B. FIGS. 16A and 16B are top views of a releasing apparatus 2300, and FIGS. 17A and 17B are cross-sectional views of the releasing apparatus 2300. FIG. 18 is a top view illustrating a state in which the shutter 2004 is mounted to the state of FIGS. 15A and 15B. FIGS. 14A, 15A, 16A, and 17A and FIGS. 14B, 15B, 16B, and 17B are detail views illustrating the respective portions in the same state, respectively. FIGS. 19A to 19C are rear views of the storage container T.

FIG. 14A corresponds to a top view before moving a claw 2030*a* (see FIGS. 16A and 16B) of the releasing apparatus 2300 of the shutter 2004, and FIG. 14B corresponds to a top view after the claw 2030*a* (see FIGS. 16A and 16B) of the releasing apparatus 2300 of the shutter 2004 has moved in a direction of an arrow S2. The releasing apparatus 2300 of the shutter 2004 has a sliding gear 2044, and a worm gear 2045 which slides within the sliding gear 2044 along with the rotation of the sliding gear 2044. Moreover, the worm gear 2045 is fixed to the slider 2030 only to slide in the direction of the arrow S2 without rotating.

The gear 2043*b* of the gear member 2043 which is a drive input portion of the driving apparatus D, the gear portion 2020*a* which is a drive input portion of the storage container T, and the sliding gear 2044 which is a drive input portion of the releasing apparatus 2300 are disposed at the same position with respect to the direction in which the storage container T is inserted or separated into or from the apparatus body 2200A. As described below, the driving force transmitted to the storage container T from the driving apparatus D, which transmits the driving force to the storage container T, is used for discharging toner inside of the storage container T as well as releasing the sealing thereof by the shutter 2004.

When the gear portion 2020*a* of the storage container T rotates during the process from FIG. 14A to FIG. 14B, the sliding gear 2044 meshed with the gear portion 2020*a* rotates, and then the worm gear 2045 is moved in the sliding gear in the direction of the arrow S2 along with the rotation of the sliding gear 2044. When the worm gear 2045 is moved in the direction of the arrow S2, the claw 2030*a* also is moved in the direction of the arrow S2 to release the sealing of the shutter 2004, as described below.

FIG. 15A corresponds to a top view before moving the claw 2030*a* (see FIGS. 16A and 16B) of the releasing apparatus 2300 of the shutter 2004, and FIG. 15B corresponds to a top view after the claw 2030*a* (see FIGS. 16A and 16B) of the releasing apparatus 2300 of the shutter 2004 has moved in the direction of the arrow S2. The releasing apparatus 2300 of the shutter 2004 has the claw 2030*a*. Meanwhile, the holding members TM have an opening Ma, a fixed portion M1, and a fixed portion M2 in sequence in the direction of the arrow S2. The claw 2030*a* is inserted in the fixed portion M1 in FIG. 15A, and the claw 2030*a* is inserted in the fixed portion M2 in FIG. 15B. The fixed portions M1 and M2 are formed as the opening into which the claws 2030*a* are inserted, respectively.

FIG. 16A corresponds to a top view before moving the claw 2030*a* (see FIGS. 16A and 16B) of the releasing apparatus 2300 of the shutter 2004, and FIG. 16B corresponds to a top view after the claw 2030*a* (see FIGS. 16A and 16B) of the releasing apparatus 2300 of the shutter 2004 has moved in the direction of the arrow S2. It can be appreciated that, as the worm gear 2045 is moved in the direction of the arrow S2, the claw 2030*a* may be moved in the direction of the arrow S2. The releasing apparatus 2300 has the slider 2030. The slider 2030 is provided with one above-described claw 2030*a*, and two limiting portions 2030X. The limiting portion 2030X has a stopping portion 2030*b* and a suppressing portion 2030*c*. FIGS. 17A and 17B correspond to a cross-sectional views of FIGS. 16A and 16B. The stopping portion 2030*b* is recessed outward as seen from the claw 2030*a*.

As illustrated in FIG. 19A, the positional relation between a "communication port 2004*a* of the shutter 2004 of the storage container T" and the "discharge port 2021*a* formed in the flange portion 2021 of the storage container T" is set so as not to overlap with each other in an uninstalled state in which the storage container T is not installed in the apparatus body 2200A. Therefore, the shutter 2004 seals the discharge port 2021*a* so as to prevent the toner in the storage container T from leaking to the outside. At this time, the shutter 2004 is in a first position K1 at the time before the storage container T is inserted into the apparatus body 2200A of the image forming apparatus 2200.

When the storage container T is gradually inserted into the apparatus body 2200A, at the stage in which the storage container T is inserted to a certain position, the shutter 2004 reaches a set position on the back of the apparatus body 2200A in the storage container T. In FIGS. 19A to 19C, a direction of an arrow J1 is an insertion direction, and a direction of an arrow J2 is a separation direction. In this position, a locking portion 2004*b* of the shutter 2004 of the storage container T is engaged with the stopping portion 2030*b* of the slider 2030 of the releasing apparatus 2300 (engaged as illustrated in FIG. 18). At this time, the claw 2030*a* is locked to the fixed portion M1 of the holding members TM (see FIG. 15A), and thereby the movement of the slider 2030 in the insertion direction of the storage container T is regulated.

When the storage container T is further inserted into the apparatus body 2200A, the locking portion 2004*b* of the shutter 2004 slides in a predetermined amount in a direction of an arrow S1 with respect to the flange portion 2021, and becomes the state illustrated in FIG. 19B.

At the time of transport or shipment of the image forming apparatus 2200, the storage container T is in the state illustrated in FIG. 19B, and at this time, the discharge port 2021*a* and the communication port 2004*a* remain at a position not overlapping with each other. Therefore, even at the time of transport or shipment, toner is not leaked from the storage container T. FIGS. 14A, 15A, 16A and 17A illustrate the state at this time. Herein, the discharge port 2021*a* is positioned coaxially with the opening Ma forming the passage which is provided in the holding member TM to be connected with the storing portion 71. At this time, the shutter 2004 in a second position K2 at the time the storage container T is inserted into the apparatus body 2200A.

When installing the apparatus body 2200A, the releasing apparatus 2300 is operated to allow toner to be discharged from the storage container T. Hereinafter, the releasing apparatus 2300 will be described. The releasing apparatus 2300, which is a 'releasing portion', releases the sealing of the shutter 2004 by using the driving force transmitted to the storage container T from the driving apparatus D. As illustrated in FIGS. 16A, 16B, 17A, and 17B, the releasing apparatus 2300 includes the slider 2030 provided with the claw 2030*a*, the stopping portion 2030*b* and the suppressing portion 2030*c*, two sliding gears 2044 and two worm gears 2045, and is installed in the holding member TM.

Figure 20:
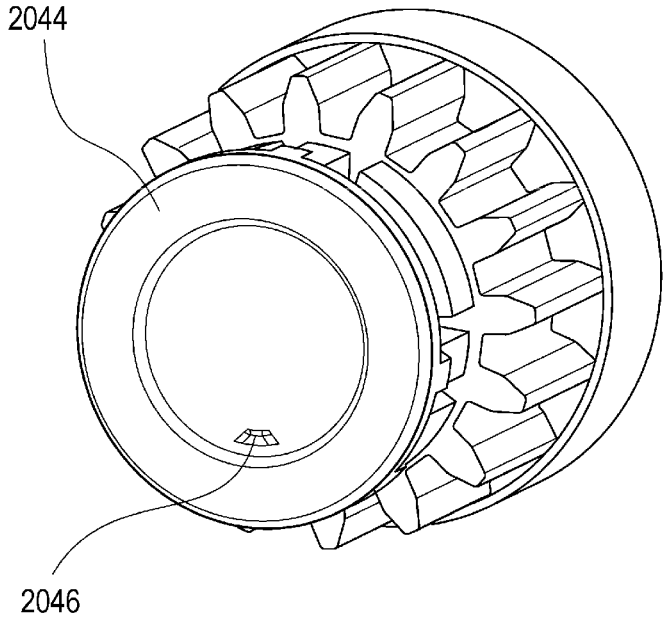
FIG. 20 is a perspective view of a slider gear.

The worm gear 2045 is fixed to the slider 30 to move as one during operation. The sliding gear 2044 which is rotatable with respect to the worm gear 2045 has a coaxial fitting relationship therewith, and when rotating, the worm gear 2045 may be moved in a thrust direction of the sliding gear 2044 by a protrusion 2046 (see FIG. 20) formed therein. Herein, as illustrated in FIG. 14A, the sliding gear 2044 is provided at a position meshed with the gear portion 2020*a*.

As illustrated in FIG. 13, based on the installation information, the gear portion 2020*a* rotates by the driving input from the motor 2080 at a predetermined time and the driving force is transmitted to the sliding gear 2044, thereby the worm gear 2045, the slider 2030 and the claw 2030*a* start to move, and then the protrusion 2046 reaches a distal end of the worm gear 2045. Then, movement of the worm gear 2045 at a predetermined amount in the direction of the arrow S2 ends, and the claw 2030*a* is moved to the fixed portion M2 to be locked thereto (see FIG. 18). Therefore, movement of the slider 2030 in the insertion direction of the storage container T is regulated again.

Further, the suppressing portion 2030*c* is bumped to a bumping portion M3 (see FIG. 18), and thereby movement of the slider 2030 in the separation direction of the storage container T is also regulated. That is, movement of the slider 2030 is completely regulated, and then, the slider 2030 is not moved by insertion and removal of the storage container T and the driving input of the motor 2080 (normal position of the slider 2030). Moreover, a receiving portion M10 which receives the bumping portion M3 is formed in the holding member TM, in addition to the above-described bumping portion M3, such that the limiting portion 2030X may be moved between the bumping portion M3 and the receiving portion M10 (see FIG. 18).

FIGS. 14B, 15B, 16B, 17B, 18 and 19C illustrate the state at this time. At this stage, the discharge port 2021*a*, the communication port 2004*a*, and the opening Ma overlap coaxially, and by operating the motor 2080, it is possible to replenish the toner from the storage container T. At this time, the shutter 2004 is in a third position K3 (see FIG. 19C) which is reached by the driving of driving apparatus D, such that the toner becomes ejectable when the shutter is in the third position K3. As described above, the shutter 2004 is movable between the first position K1, the second position K2, and the third position K3.

As described above, since the present embodiment is configured to communicate the communication port 2004*a* with the opening Ma by moving the slider 2030 to the normal position, after the slider 2030 is moved to the normal position, the shutter 2004 is opened and closed by attaching and detaching the storage container T.

In particular, when inserting the body, the shutter 2004 is moved from the state illustrated in FIG. 19A to a moving amount of X1+X2 along with the insertion of the body, and the shutter 2004 moves to the state illustrated in FIG. 19C. Therefore, the body is completely inserted, and the toner can be replenished. The releasing apparatus 2300 releases the sealing of the shutter 2004 only when the driving apparatus D is driven for the first time. Moreover, the shutter 2004 is mounted on the storage container T, and, when the storage container T is inserted into the apparatus body 2200A of the image forming apparatus 2200, slides to a direction (the direction of the arrow S1 or the direction of the arrow S2) opposite to the direction (the direction of the arrow J1) where it is inserted therein. In addition, when the storage container T is separated from the apparatus body 2200A, the shutter 2004 slides to a direction (direction reverse to the direction of the arrow S1 or the direction of the arrow S2) opposite to the direction (direction of the arrow J2) where it is separated therefrom.

Third Embodiment

Hereinafter, a third embodiment will be described, while components of the third embodiment having the same configuration as the second embodiment are denoted by the same reference numerals and will be described below. As illustrated in FIG. 13, based on the installation information, the gear portion 2020*a* rotates by the driving input from the motor 2080 at a predetermined time, and the driving is transmitted to the sliding gear 2044, thereby the worm gear 2045, the slider 2030 and the claw 2030*a* start to move, and the pump portion 2020*b* is expanded and compressed.

Herein, toner near the pump portion 2020*b* flows along with the expanding and compressing operation of the pump portion 2020*b*, and the pressed-solidified toner (tapped toner) by vibration during transport is loosened to reduce the bulk density thereof. Due to the flowing of the toner to the discharge port 2021*a* near the pump portion 2020*b*, the bulk density of the toner near the discharge port 2021*a* is reduced.

The reduced bulk density of the toner reaches the state in normal use of the storage container T so as to stabilize the toner replenishment amount after the shutter 2004 is opened. If the toner is discharged from the discharge port 2021*a* without the flowing of the toner, the bulk density (replenishment amount) thereof reaches about 4 times that of when in normal use. In this time, if the toner flows into the developing apparatus 2100, image defects due to toner scattering and uneven density caused by the excessive toner may occur.

In order to flow the toner, the pump portion 2020*b*, which is an 'agitating portion' capable of agitating the toner, is disposed in the storage container T. After the toner in the storage container T is agitated by the pump portion 2020*b*, the sealing of the shutter 2004 is released by the releasing apparatus 2300. Herein, the pump portion 2020*b* has the same mechanism as the discharging portion for discharging the toner, and is interlocked with the operation of the discharging portion; however, the agitating portion may have a mechanism different from the toner discharging portion.

By the configuration of the above-described second embodiment or third embodiment, after shipment (transport) with the storage container T packaged together in the apparatus body 2200A and installation thereof, the shutter 2004 is opened and closed only by attaching and detaching the storage container T. Therefore, it is possible to suppress the toner scattering.

According to the present invention, the sealing by the shutter of the bottle and opening by the shutter of the bottle are made possible in a state of being attached to the main body. Thus, it is possible to ship in the state of mounting the toner in the body and suppress the toner scattering or leakage, without increasing the size of the apparatus and costs.

While the present invention has been described with reference to exemplary embodiments, it is to be understood that the invention is not limited to the disclosed exemplary embodiments. The scope of the following claims is to be accorded the broadest interpretation so as to encompass all such modifications, equivalent structures and functions.

This application claims the benefit of Japanese Patent Application No. 2013-132533, filed Jun. 25, 2013, and Japanese Patent Application No. 2013-179550, filed Aug. 30, 2013, which are hereby incorporated by reference herein in their entirety.

What is claimed is:

1. An image forming apparatus comprising:

a bottle which is detachably attached to an apparatus main body and which stores toner, the bottle having a discharge port from which the toner stored is discharged;

a shutter which is disposed on the bottle to open and close the discharge port; and an engaging member which is movably disposed on the apparatus main body and configured to engage the shutter, wherein in a case that the engaging member is in an operating position, the engaging member engages with the shutter so as to open the discharge port by an attaching operation of the bottle into a set position, and wherein in a case that the engaging portion is in a non-operating position where the engaging member is retracted from the operating position, the shutter maintains a closed status of the discharge port when the bottle is attached at the set position.

2. The image forming apparatus according to claim 1, further comprising:

a drive transmission member configured to move between a transmitting position where a driving force for driving the bottle can be transferred and a blocking position where the driving force is blocked;

a driving mechanism to drive the driving transmission member and the engaging member; and a single driving source which drives the driving mechanism, wherein the driving mechanism is configured such that the driving transmission member moves to the transmitting position from the blocking position after the engaging member moves from the non-operating position to the operating position.

3. The image forming apparatus according to claim 2, further comprising a stopper member which is disposed movably between a restricting position where the stopper member and the drive transmission member are engaged to restrict the drive transmission from moving from the blocking position to the transmitting position, and a permitting position where the stopper member and the driving transmission member release their engagement to permit the drive transmission member to move from the blocking position to the transmitting position, wherein the stopper member is moved from the restricting position to the permitting position after the engaging member moves from the non-operating position to the operating position.

4. The image forming apparatus according to claim 3, wherein the drive transmission member includes:

a pivot gear which is pivotally disposed, a drive gear which transfers driving force to the bottle, and a pivot arm which is pivotably provided to hold the pivot gear and connect or disconnect the pivot gear to or from the drive gear, wherein when the stopper member is engaged with the pivot arm, the pivot gear is disconnected from the drive gear, and wherein when the stopper member is disengaged with the pivot arm, the pivot gear is connected to the drive gear.

5. The image forming apparatus according to claim 1, wherein a driving source commonly drives the engaging member and the bottle.

6. The image forming apparatus according to claim 5, wherein the driving source is configured to drive the bottle during movement of the engaging member from the non-operating position to the operating position by the driving source.

7. The image forming apparatus according to claim 1, further comprising a driving portion which drives the engaging member from the non-operating position to the operating position.

8. The image forming apparatus according to claim 7, further comprising an operation portion which allows a user to input installation information, wherein the driving portion is driven based on the installation information input from the operation portion by the user.

9. An image forming apparatus according to claim 1, wherein the engaging member is restricted from moving to the operating position before an initial setting operation of the apparatus main body is finished and the engaging member is restricted from moving to the non-operating position after an initial setting operation of the apparatus main body is finished.

10. An image forming apparatus according to claim 1, wherein the shutter is slidably disposed in a bottle attachment direction and the engaging member is configured to move from the non-operating position to the operating position in the bottle attachment direction, and the engaging member engages with the shutter of the bottle at the set position to move the shutter from a close position where the shutter closes the discharge port to an open position where the shutter opens the discharge port when the engaging member moves from the non-operating position to the operating position.

11. An image forming apparatus according to claim 1, wherein the bottle is disposed at the set position at shipping, the engaging member is disposed at the non-operating position at shipping, and the engaging member is kept at the operating position after the engaging member first moves to the operating position.

12. An image forming apparatus according to claim 1, wherein in a case that the bottle is a first new bottle and the first new bottle is attached to the apparatus main body, the engaging member is positioned at the non-operating position, and wherein after the engaging member moves to the operating position, the engaging member is kept at the operating position and when a next new bottle is attached into the set position, the shutter moves to an open position to open the discharge port from a close position to close the discharge port, according to an attachment operation of the bottle into the set position.

* * * * *